US007104477B2

(12) United States Patent
Kilgore et al.

(10) Patent No.: US 7,104,477 B2
(45) Date of Patent: Sep. 12, 2006

(54) AIR ASSIST FUEL INJECTOR GUIDE ASSEMBLY

(75) Inventors: David Kilgore, Williamsburg, VA (US); William June Rogers, Hampton, VA (US); Scott P. Dillon, Newport News, VA (US); Gary Lee Maschke, Yorktown, VA (US); James Allen Kimmel, Williamsburg, VA (US)

(73) Assignee: Synerject, LLC, Newport News, VA (US)

( * ) Notice: Subject to any disclaimer, the term of this patent is extended or adjusted under 35 U.S.C. 154(b) by 609 days.

(21) Appl. No.: 09/950,586

(22) Filed: Sep. 13, 2001

(65) Prior Publication Data

US 2003/0047624 A1 Mar. 13, 2003

(51) Int. Cl.
*B05B 1/30* (2006.01)

(52) U.S. Cl. ..... 239/585.1; 239/585.3; 239/585.4; 239/585.5; 239/533.2; 239/533.3

(58) Field of Classification Search ..... 239/585.1, 239/585.3, 585.4, 585.5, 533.2, 533.3, 533.9, 239/533.11, 88, 89, 91; 251/129.15, 129.21, 251/127

See application file for complete search history.

(56) References Cited

U.S. PATENT DOCUMENTS

| | | | | |
|---|---|---|---|---|
| 3,782,639 | A | | 1/1974 | Boltz et al. |
| 4,434,766 | A | | 3/1984 | Matsuoka et al. |
| 4,934,329 | A | | 6/1990 | Lear et al. |
| 5,004,162 | A | * | 4/1991 | Stettner et al. ..... 239/585.1 |
| 5,069,189 | A | * | 12/1991 | Saito ..... 123/533 |
| 5,113,829 | A | | 5/1992 | Motoyama |
| 5,115,786 | A | | 5/1992 | Yamada |
| 5,123,399 | A | | 6/1992 | Motoyama et al. |
| 5,170,766 | A | | 12/1992 | Haas et al. |
| 5,307,997 | A | * | 5/1994 | Wakeman ..... 239/491 |
| 5,358,181 | A | | 10/1994 | Tani et al. |
| 5,544,816 | A | * | 8/1996 | Nally et al. ..... 239/585.5 |
| 5,623,904 | A | | 4/1997 | Matsumoto |
| 5,655,715 | A | | 8/1997 | Hans et al. |
| 5,694,906 | A | | 12/1997 | Lange et al. |
| 5,730,367 | A | | 3/1998 | Pace et al. |
| 5,738,077 | A | | 4/1998 | Kim |
| 5,794,856 | A | * | 8/1998 | Nally ..... 239/408 |
| 5,819,706 | A | | 10/1998 | Tsuchida et al. |
| 5,906,190 | A | | 5/1999 | Hole et al. |
| 5,979,786 | A | | 11/1999 | Longman et al. |
| 5,983,865 | A | | 11/1999 | Yamashita et al. |
| RE36,768 | E | | 7/2000 | Lear et al. |
| 6,095,111 | A | | 8/2000 | Ueda et al. |
| 6,209,806 | B1 | | 4/2001 | Pace et al. |
| 6,302,337 | B1 | | 10/2001 | Kimmel |
| 6,360,960 | B1 | * | 3/2002 | Nally, Jr. et al. ..... 239/5 |
| 6,374,808 | B1 | * | 4/2002 | Fulford et al. ..... 123/458 |

FOREIGN PATENT DOCUMENTS

| | | |
|---|---|---|
| CH | 142253 | 11/1930 |
| CH | 296115 | 4/1954 |
| DE | 494740 | 3/1930 |
| DE | 841080 | 6/1952 |
| DE | 38 27 348 A1 | 3/1989 |
| DE | 199 18 226 A1 | 11/2000 |
| EP | 0 494 468 A1 | 7/1992 |
| EP | 1 020 639 A2 | 7/2000 |
| GB | 22618 | of 1913 |
| WO | WO 87/00583 A1 | 1/1987 |

* cited by examiner

*Primary Examiner*—Davis Hwu
(74) *Attorney, Agent, or Firm*—Cooley Godward LLP

(57) ABSTRACT

Air assist fuel injectors having one or more inserts that guide movement of a poppet, and an air assist fuel injector having a solid poppet.

76 Claims, 31 Drawing Sheets

AIR ASSIST FUEL INJECTOR GUIDE ASSEMBLY

BACKGROUND OF THE INVENTION

1. Field of the Invention

The present invention relates to air assist fuel injectors, and, more particularly, to inserts that guide movement of the poppets of such air assist fuel injectors and to air assist fuel injectors having solid poppets.

2. Description of the Related Art

Conventional fuel injectors are configured to deliver a quantity of fuel to a combustion cylinder of an engine. To increase combustion efficiency and decrease pollutants, it is desirable to atomize the delivered fuel. Generally speaking, atomization of fuel can be achieved by supplying high pressure fuel to conventional fuel injectors, or atomizing low pressure fuel with pressurized gas, i.e., "air assist fuel injection."

Conventional air assist fuel injectors are typically mounted to a rail, which houses a conventional fuel injector and also defines a mount for the air assist fuel injector. The conventional fuel injector and the rail are configured such that a metered quantity of fuel is delivered from the fuel injector to the air assist fuel injector. Additionally, the rail includes a number of passageways that deliver pressurized air to the air assist fuel injector. The air assist fuel injector atomizes the low pressure fuel with the pressurized air and conveys the air and fuel mixture to the combustion chamber of an engine.

The pressurized gas and liquid fuel typically travel through the interior of a hollow poppet of conventional air assist fuel injectors, and exit the poppet through slots near a head of the poppet. The poppet is reciprocatable in a leg and a head of the poppet typically lifts off a seat to deliver a plume of atomized fuel from the air assist fuel injector to the combustion chamber of an engine. The seat and leg of such conventional air assist fuel injectors each include a bearing surface to guide movement of the poppet. Unfortunately, the finish dimensions of these bearing surfaces are typically set during complex and time consuming grinding operations. If these finish dimensions are not precise, the air assist fuel injector may fail or function improperly because of improper alignment of the poppet. Additionally, the hollow poppets of such conventional air assist fuel injectors are also difficult to manufacture.

SUMMARY

In light of the previously described problems associated with conventional air assist fuel injectors, one object of the embodiments of the present invention is to provide air assist fuel injectors having an insert that guides movement of the poppet of air assist fuel injectors.

Another object of the embodiments of the present invention is to provide an air assist fuel injector having a solid poppet.

Other objects, advantages and features associated with the embodiments of the present invention will become more readily apparent to those skilled in the art from the following detailed description. As will be realized, the invention is capable of other and different embodiments and its several details are capable of modification in various obvious aspects, all without departing from the invention. Accordingly, the drawings and the description are to be regarded as illustrative in nature, and not limitative.

DESCRIPTION OF SPECIFIC EMBODIMENTS

Figure 1:
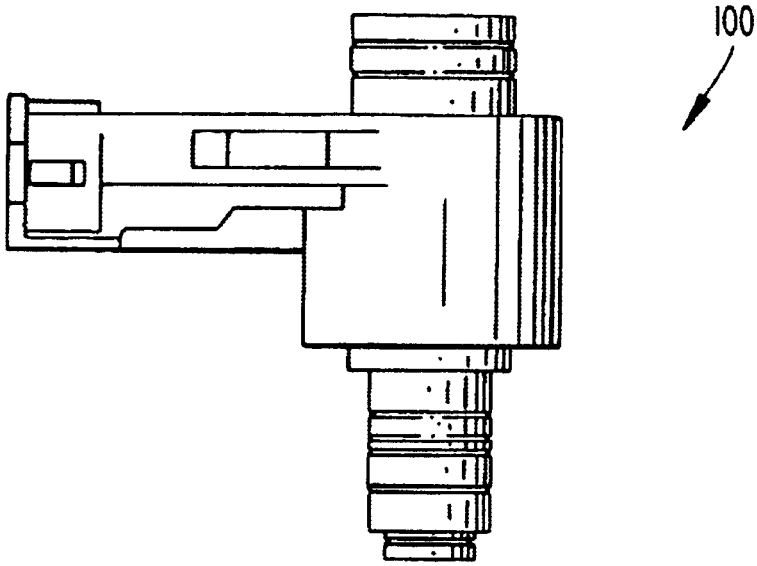
FIG. 1 is a side view of an air assist fuel injector configured for an engine in accordance with one embodiment of the present invention.
Figure 2:
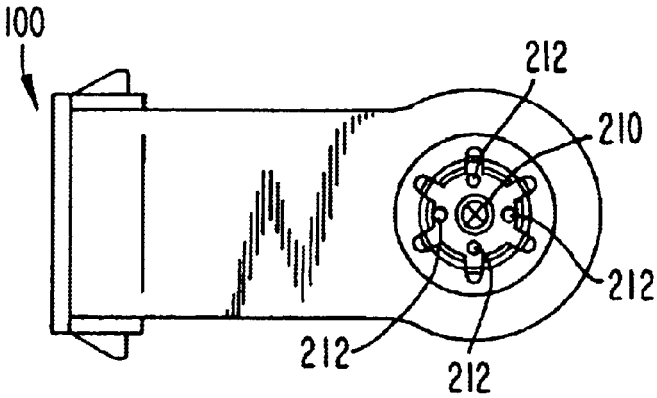
FIGS. 2 and 3 are top and rear views respectively of the air assist fuel injector illustrated in FIG. 1.
Figure 3:
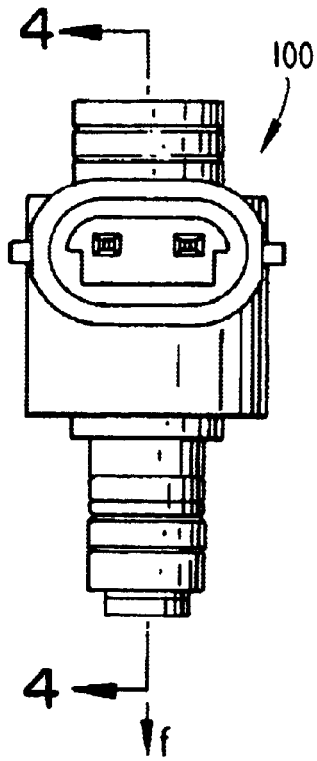
Figure 4:
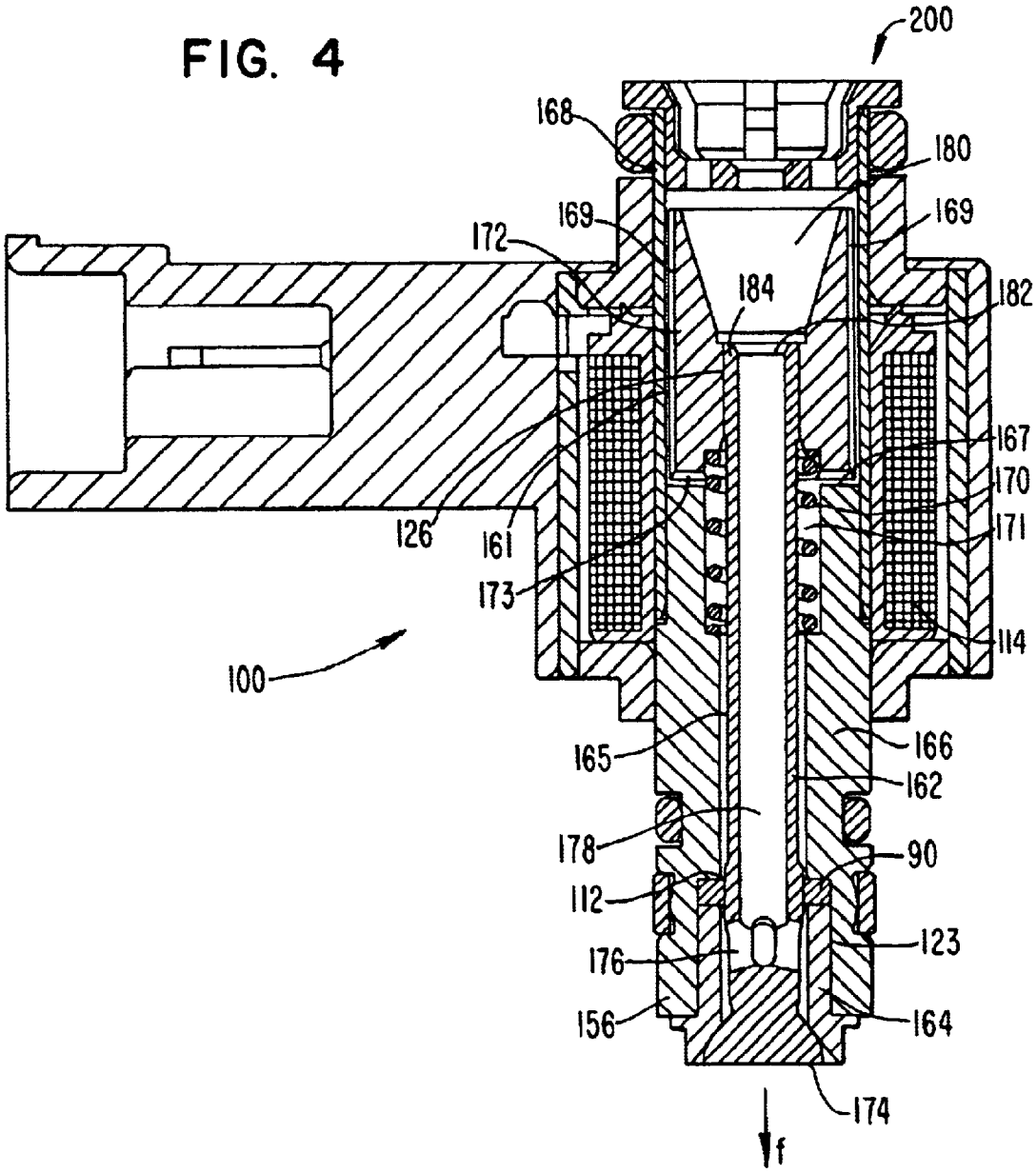
FIG. 4 is a cross-sectional view of the air assist fuel injector illustrated in FIG. 1 taken along the line 4—4 in FIG. 3.
Figure 5:
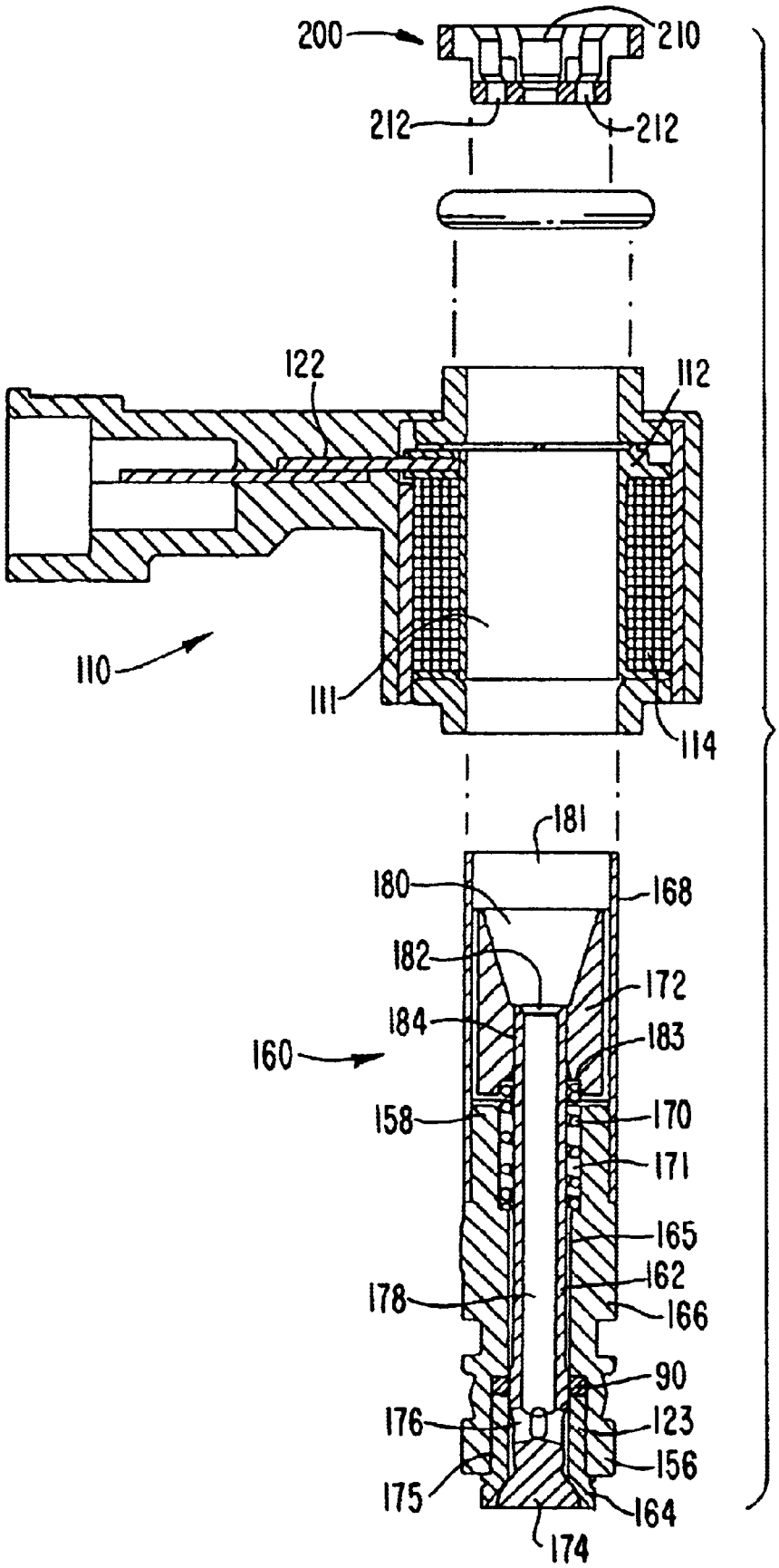
FIG. 5 is an exploded view of FIG. 4.

FIGS. 1–7 illustrate one embodiment of an air assist fuel injector 100 having an insert 90 for guiding movement of a poppet 162 in accordance with the present invention. The air assist fuel injector 100 is configured for use with a two-stroke internal combustion engine. However, alternative embodiments of the air assist fuel injector 100 are configured for operation with other engines. For example, the air assist fuel injector 100 may be configured for operation with a four stroke internal combustion engine. The air assist fuel injector 100 is configured to utilize pressurized gas to atomize low pressure liquid fuel, which together travel through the air assist fuel injector 100 along a direction of flow f as indicated in FIGS. 3 and 4. As illustrated in FIG. 5, the air assist fuel injector 100 includes two primary assemblies: an actuator assembly 110 and a valve assembly 160.

The actuator assembly 110 includes a solenoid coil 114 of conductive wire wrapped around a tubular bobbin 112. The solenoid coil 114 has two ends that are each electrically connected to terminals 122. The solenoid coil 114 is energized by providing current to the terminals 122. The bobbin 112 of the actuator assembly 110 is a spool on which the conductor of the solenoid coil 114 is wound. The bobbin 112 also defines a through hole 111 in which an armature 172 is electromagnetically actuated as further described below. Alternative embodiments of the actuator assembly 110 need not include the solenoid coil 114. For example, in an alternative embodiment, the actuator assembly 110 is a piezoelectric actuator.

Figure 6:
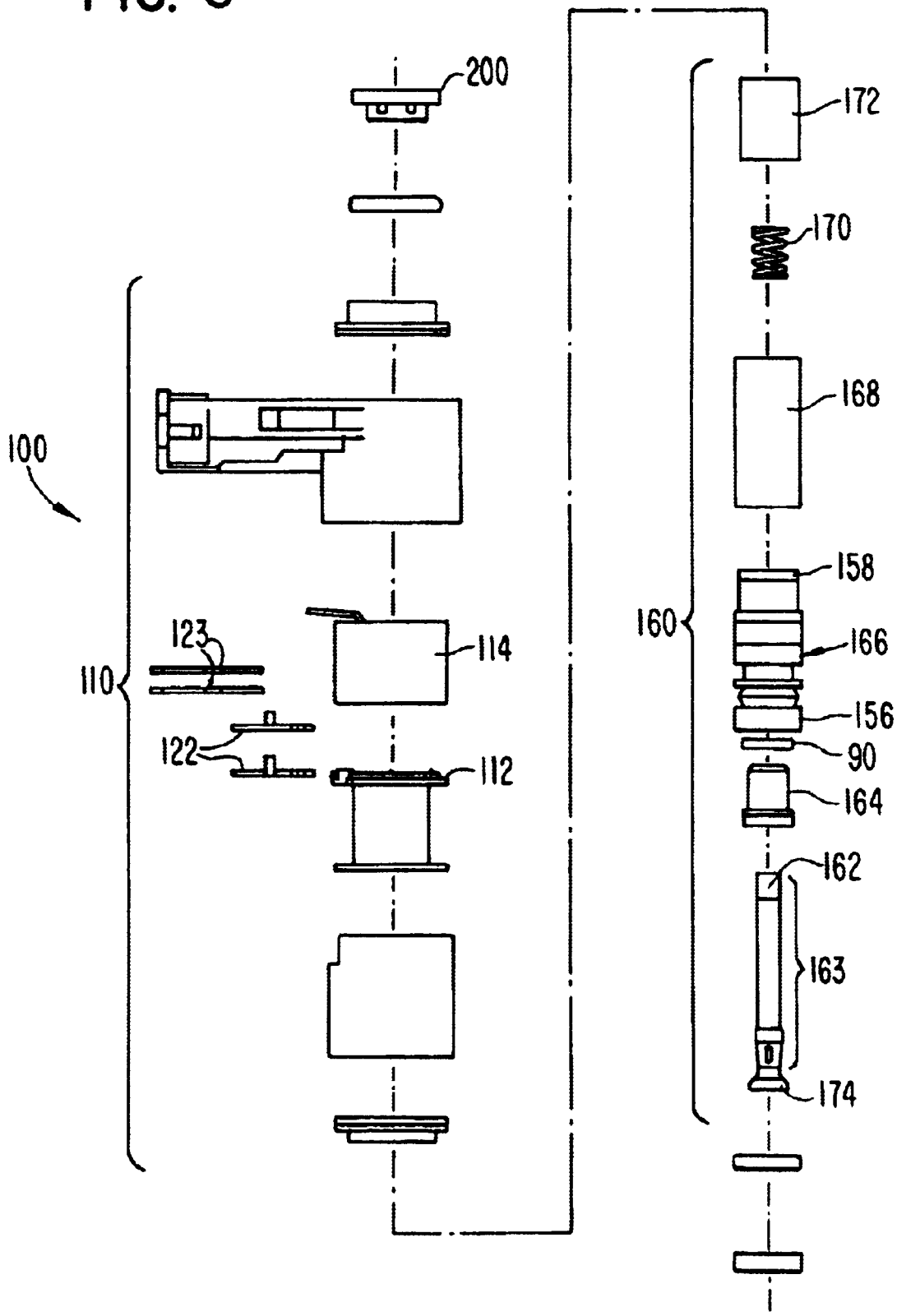
FIG. 6 is an exploded assembly view of the air assist fuel injector illustrated in FIG. 1.

Referring to FIGS. 5 and 6, the valve assembly 160 of air assist fuel injector 100 defines the dynamic portion of the air assist fuel injector that functions as a valve to deliver the atomized quantity of liquid fuel and gas. As illustrated in FIGS. 5 and 6, the valve assembly 160 includes an armature 172, a poppet 162, a seat member 164, a leg 166, a spring 170, a sleeve 168, and an insert 90. The armature 172 is formed of a ferromagnetic material, such as 430 FR stainless steel or similar, and functions as the moving part of an electromagnetic actuator, defined by the solenoid coil 114 and armature 172 combination. As illustrated in FIG. 4, the armature 172 of the air assist fuel injector 100 is located relative to the solenoid coil 114 such that the armature 172 is subject to the lines of magnetic flux generated by the solenoid coil 114. Hence, the armature 172 is actuated when the solenoid coil 114 is energized. In the preferred embodiment, the armature 172 is located partially within the throughhole 111 of the bobbin 112.

The armature 172 includes a passageway 180 that conveys a mixture of liquid fuel and gas to an inlet 182 of the poppet 162. In the preferred embodiment, the passageway 180 of the armature 172 includes a conical conduit extending from a first end of the armature 172 adjacent the cap 200 to the inlet 182 of the poppet 162. However, the passageway 180 may take other forms. For example, the passageway 180 may be one cylindrical passageway extending the entire length of the armature 172, a plurality of passageways, or other configurations, as will be apparent.

The poppet 162 is attached to the armature 172, which is actuated by energizing the solenoid coil 114. As illustrated in FIGS. 5 and 6, in the preferred embodiment, the armature 172 includes a cylindrical passageway 126 located downstream of the passageway 180 and that matingly receives a distal or upstream end portion 184 of the poppet 162. Hence, the inlet 182 is located immediately downstream of the passageway 180 with respect to the direction of flow of the mixture of liquid fuel and gas. In the preferred embodiments, the end portion 184 of the poppet 162 is attached to the armature 172 with a welded connection, preferably a YAG laser weld. However, alternative attachments are also contemplated. For example, the poppet 162 may be attached to the armature 172 at any of a variety of locations with an interference fit, an adhesive, a threaded or screwed attachment, a lock and key attachment, a retaining ring attachment, an electron beam weld, an ultrasonic weld, or other known attachments. Because the poppet 162 is attached to the armature 172, the poppet will move with the armature when the armature is actuated by energizing the solenoid coil 114. In alternative embodiments, the passageway 180 extends between the upstream end face and the opposing, downstream end face of the armature 172, i.e., the entire length of the respective armature, and the distal end portion 184 of the poppet 162 is attached to the armature 172 at the downstream end face of the armature 172.

The poppet 162 is a member that reciprocates in the air assist fuel injector 100 to open and close the valve assembly 160. In the illustrated embodiment the poppet 162 is an elongated and hollow tube for conveying the mixture of liquid fuel and pressurized gas, and includes an elongated stem 163 and a head 174. The inlet 182 of the poppet 162 opens into a tubular passageway 178 that extends from the inlet 182 to an outlet 176, which is located just upstream of the head 174. In a preferred embodiment, the poppet 162 includes four slot-shaped outlets 176 that are equally spaced from each other and located approximately transverse to the longitudinal axis of the poppet 162. Although preferred that the poppet 162 have four slot-shaped outlets 176, other configurations will suffice. For example, the poppet 162 may include one slot shaped outlet, two circular outlets, five oval outlets, or ten pin sized outlets.

The poppet head 174 is located at the proximal end of the poppet downstream of the stem 163 and includes a conical or angled face that seats against the seat member 164 to define a seal when the solenoid coil 114 is not energized. When the armature 172 is actuated by energizing the solenoid coil 114, the poppet 162 moves with the armature 172 such that the head 174 lifts off of the seat member 164 in a direction away from the air assist fuel injector 100. When the head 174 lifts off of the seat member 164, a seal is broken between the head 174 and the seat member 164 such that liquid fuel and gas exiting the outlets 176 exits the air assist fuel injector 100. The seat 164 is preferably fabricated from a wear and impact resistant material, such as hardened 440 stainless steel. As is illustrated in FIG. 4, the poppet 162 also includes a bearing face 112, which, as described further below, is a surface that engages another surface to guide movement of the poppet.

As further illustrated in FIGS. 4 and 5, the poppet 162 moves within a channel 165 of the leg 166. The leg 166 is a body through which the poppet 162 reciprocates and that supports the seat 164. In the preferred embodiment, the interior channel 165 extends completely through the leg 166 along the longitudinal center axis of the leg. As illustrated in FIGS. 4 and 5, the channel 165 includes a bore 123 at a proximal end portion 156 of the leg that defines a recess that receives the seat 164. In the preferred embodiment, the bore 123 has a diameter that is greater than the diameter of the portion of the channel 165 located immediately upstream of the bore. In an alternative embodiment, the seat 164 includes a recess that receives the leg 166. It will also be appreciated that in alternative embodiments the seat 164 may be more elongated than the leg 166. As described further below, the poppet 162 also includes a bearing surface 112 that is engaged by the insert 90 to guide movement of the poppet within the leg 166.

The spring 170 of the valve assembly 160 is located between the armature 172 and the leg 166. More particularly, the spring 170 sits within a bore 171 of the channel 165 at the distal end portion 158 of the leg 166. In the preferred embodiment, the bore 171 has a diameter that is greater than the diameter of the portion of the channel located immediately downstream of the bore 171. The bore 171 faces the armature 172 and defines a recess and seat for the spring 170. The spring 170 is a compression spring having a first end that abuts the armature 172 and a second end that abuts the leg 166. The bottom of the bore 171 defines the seat for the downstream end of the spring 170 and a recess 183 in the armature 175 defines a seat for the upstream end of the spring 170. The spring 170 functions to bias the armature 172 away from the leg 166. When the solenoid coil 114 is not energized, the spring 170 biases the armature 172 away from the leg 166 and thus the poppet 162 is maintained in a closed position where the head 174 abuts against the seat member 164. However, when the solenoid coil 114 is energized, the electromagnetic force causes the armature 172 to overcome the biasing force of the spring 170 such that the armature 172 moves toward the leg 166 until it abuts a stop surface 167 of the leg 166. When the solenoid coil 114 is de-energized, the electromagnetic force is removed and the spring 170 again forces the armature 172 away from the stop surface 167. In this manner, the poppet 162 reciprocates in the channel 165 of the leg 166.

As illustrated in FIGS. 4–6, the armature 172 is received by a sleeve 168, which is preferably a cylindrical tube that extends at least a portion of the length of the armature 172. Movement of the armature 172 is preferably guided by a bearing 161 between the outer surface of the armature 172 and the inner surface of the sleeve 168. Hence, the passageway 181 of the sleeve 168 receives the armature 172 and slidably engages the armature 172. As is also illustrated in FIGS. 4 and 5, the armature 172 preferably includes grooves 169 in and along the length of the cylindrical exterior surface of the armature, as well as grooves 173 in the end face of the armature that faces the leg 166. In an alternative embodiment, the interior surface of the sleeve 168 does not slidably engage the armature 172 and thus does not serve as a bearing surface for the armature 172. In this alternative embodiment, the air assist fuel injector 100 may include an additional bearing at the stem 163 of the poppet 162. For a further embodiment, the valve assembly 160 does not include the sleeve 168.

The air assist fuel injector 100 also includes a cap 200 that defines an inlet to the air assist fuel injector 100 for the pressurized gas and liquid fuel. The cap 200 is the interface between a rail 500 (described below with reference to FIG. 7), and the air assist fuel injector 100, and serves to direct the liquid fuel and gas to the passageway 180 of the armature 172. As illustrated in FIGS. 2, 4 and 5, the cap 200 includes at least one fuel passageway 210 that primarily receives liquid fuel and at least one gas passageway 212 that receives pressurized gas. Alternative embodiments of the air assist fuel injector 100 do not include the cap 200.

The air assist fuel injector 100 utilizes pressurized air to atomize low pressure fuel. When installed in an engine, the air assist fuel injector 100 is located such that the atomized low pressure fuel that exits the air assist fuel injector 100 is delivered to the internal combustion chamber of an engine, i.e., the part of an engine in which combustion takes place, normally the volume of the cylinder between the piston crown and the cylinder head, although the combustion chamber may extend to a separate cell or cavity outside this volume. For example, as illustrated by FIG. 7, the air assist fuel injector 100 is located in a cavity 704 of a two stroke internal combustion engine head 702 such that the air assist fuel injector 100 can deliver a metered quantity of atomized liquid fuel to a combustion cylinder 703 of the two stroke internal combustion engine 700, where it is ignited by a spark plug or otherwise.

Figure 7:
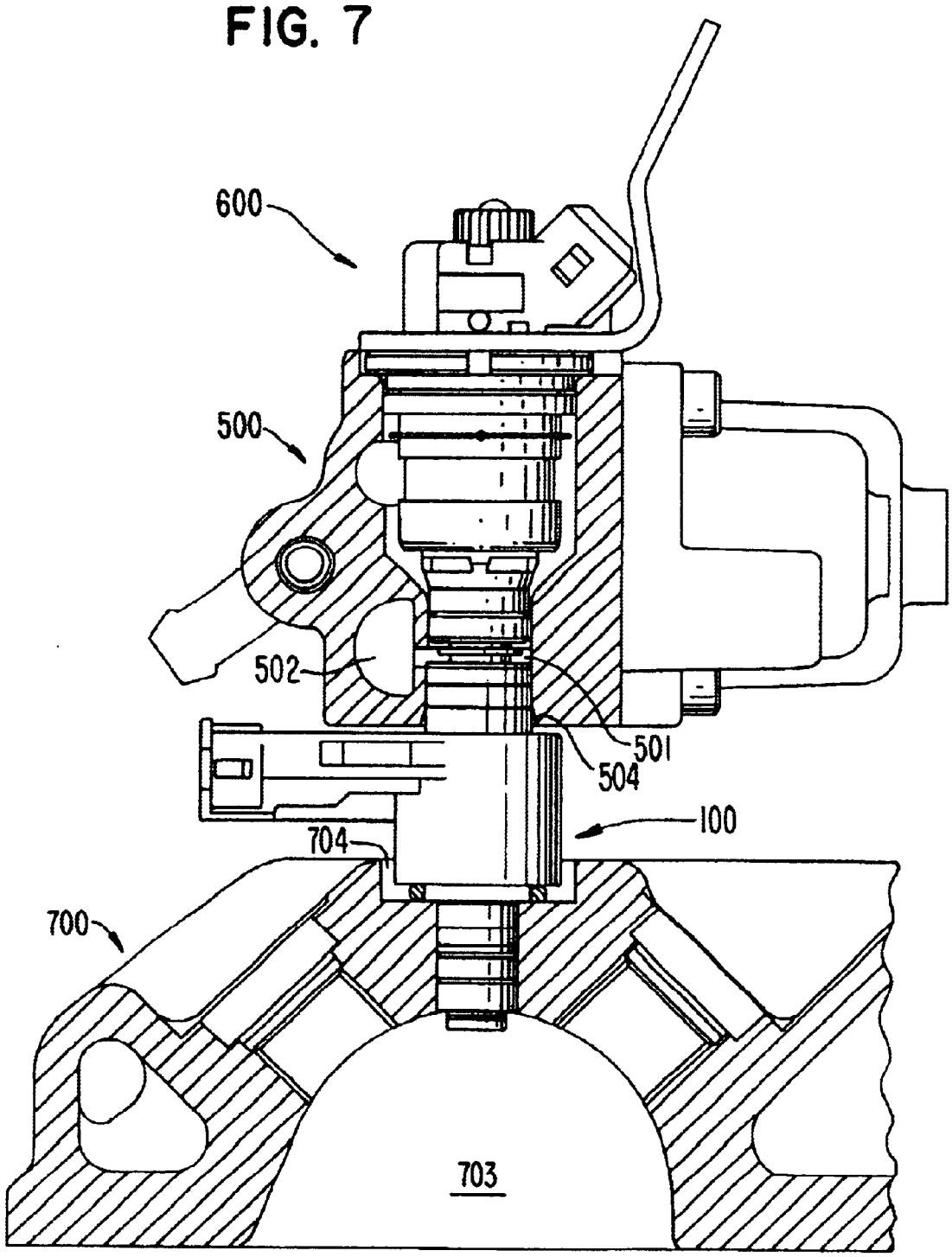
FIG. 7 is a partial cross-sectional view of the air assist fuel injector illustrated in FIG. 1 located in the head of a two-stroke internal combustion engine.

As illustrated by FIG. 7 the air assist fuel injector 100 is located adjacent a conventional fuel injector 600. The fuel injector 600 is located at least partially in a cavity of the rail 500, which includes one or more internal passageways or external lines (not illustrated) that deliver liquid fuel to the fuel injector 600, as well as one or more passageways 502 that deliver pressurized gas, preferably air, to the air assist fuel injector 100. The rail 500 also defines a mount for the air assist fuel injector 100. That is, the rail 500 abuts at least one surface of the respective air assist fuel injector 100 to retain the air assist fuel injector 100 in place in the cavity 704 of the head 500. The conventional fuel injector 600 is configured and located such that it delivers a metered quantity of liquid fuel directly to the cap 200 of the air assist fuel injector 100. Hence, the cap 200 receives the pressurized gas from the rail 500 as well as the liquid fuel from the conventional fuel injector 600.

The air assist fuel injector 100 is referred to as "air assist" because it preferably utilizes pressured air to atomize liquid fuel. Although it is preferred that the air assist fuel injector atomize liquid gasoline with pressurized air, it will be appreciated that the air assist fuel injector 100 may atomize many other liquid combustible forms of energy with any of a variety of gases. For example, the air assist fuel injector 100 may atomize liquid kerosene or liquid methane with pressurized gaseous oxygen, propane, or exhaust gas. Hence, the term "air assist" is a term of art, and as used herein is not intended to dictate that the air assist fuel injector 100 be used only with pressurized air.

As described above, the pressurized gas and the liquid fuel exits the cap 200 and then enters the armature 172 located immediately downstream of the cap 200 with respect to the direction of flow f. The liquid fuel and pressurized gas mix in the passageway 182 of the armature 172 and are conveyed to the inlet 182 of the poppet 162. Thereafter, the liquid fuel and gas travel through the passageway 178 of the poppet 162. When the solenoid coil 114 is energized, the armature 172 overcomes the biasing force of the spring 170 and moves toward the leg 166 until it seats against the leg 166. Because the poppet 162 is attached to the armature 172, the head 174 of the poppet 162 lifts off of the seat in the direction of flow f when the armature 172 is actuated. When the head 174 lifts off of the seat 164, a seal between the head and the seat is broken and the gas and fuel mixture exits the outlet 176. The mixture exiting the outlet 176 is then forced out of the air assist fuel injector 100 over the head 174 such that a metered quantity of atomized liquid fuel is delivered to the combustion chamber 703.

Figure 40:
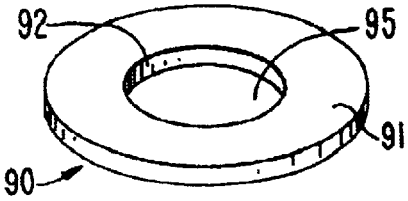
FIG. 40 is a perspective view of a first embodiment of an insert for use with an air assist fuel injector according to the present invention.
Figure 44:
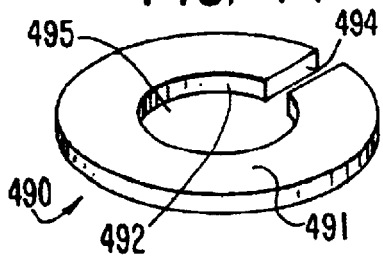
FIG. 44 is a perspective view of a fifth embodiment of an insert for use with an air assist fuel injector according to the present invention.

Because the poppet 162 reciprocates in the channel 165 of the leg 166, movement of the poppet is guided with one or more bearings. To avoid difficulties in grinding a bearing surface in the leg 166 and/or the seat 164, it is preferred to guide the movement of the poppet 162 with at least one insert 90 having a bearing surface 92 that slidably engages a bearing surface 112 of the stem 163 of the poppet 162. Hence, movement of the poppet 162 is guided at a bearing between the poppet 162 and the insert 90. The insert 90 is separate from the seat 164 and the leg 166, meaning that the insert 90, the seat 164, and the leg 166 each are separately fabricated items. As illustrated in FIG. 40, the insert 90 of the air assist fuel injector 100 is a planar disk having an annular wall 91 with a cylindrical throughole 95 passing therethrough. That is, the insert 90 resembles a flat washer. The throughole 95 is defined by the bearing surface 92, which slidably engages the bearing surface 112 of the poppet 162. In the illustrated embodiment, the insert 90 is located upstream of the outlet 176 with respect to the direction of flow f of the liquid fuel and gas through the injector 100, preferably between opposing annular faces of the seat 164 and the leg 166. More particularly, the insert 90 is located in the bore 123 of the leg 166 at the proximal end 156 of the leg that receives the seat 164. The insert 90 is preferably attached to the leg 166 and/or the seat 164, such as with a weld, an adhesive, a threaded attachment, a press-fit, or other attachment. In a further embodiment, the insert 90 is slip fit into the bore 123 of the leg 166 and permitted to move slightly with respect to the seat 164 and the leg 166 along the longitudinal axis of the poppet 162. In another embodiment, the insert 90 is retained in position solely by the opposing forces of the leg 166 and the seat 164.

Although preferred that the insert 90 guide movement of the poppet at the illustrated location, it will be appreciated that the insert 90 may be disposed at other locations. For example, the bearing surface 165 and insert 90 may be located at a position upstream or downstream of that illustrated in FIGS. 4 and 5.

In the preferred embodiment, the bearing surface 92 of the insert 90 is a turned surface, i.e., a surface produced with a lathe tool or similar machine tool without subsequent grinding or polishing operations. Because the bearing surface 92 is fabricated by turning to dimensions that are suitable for guiding movement of the poppet 162, the seat 164 and/or leg 166 need not be subjected to a grinding operation to produce a bearing surface therein. Hence, the inclusion of the insert 90 in the valve assembly 160 reduces the complexity of the valve assembly and the air assist fuel injector 100. In alternative embodiments, the bearing surface 92 may be fabricated by stamping, drawing, or metal injection molding. In the illustrated embodiment, the insert 90 is fabricated from 300 series stainless steel and has a thickness of between 0.5–6 mm, preferably between 1–3 mm.

Figure 39:
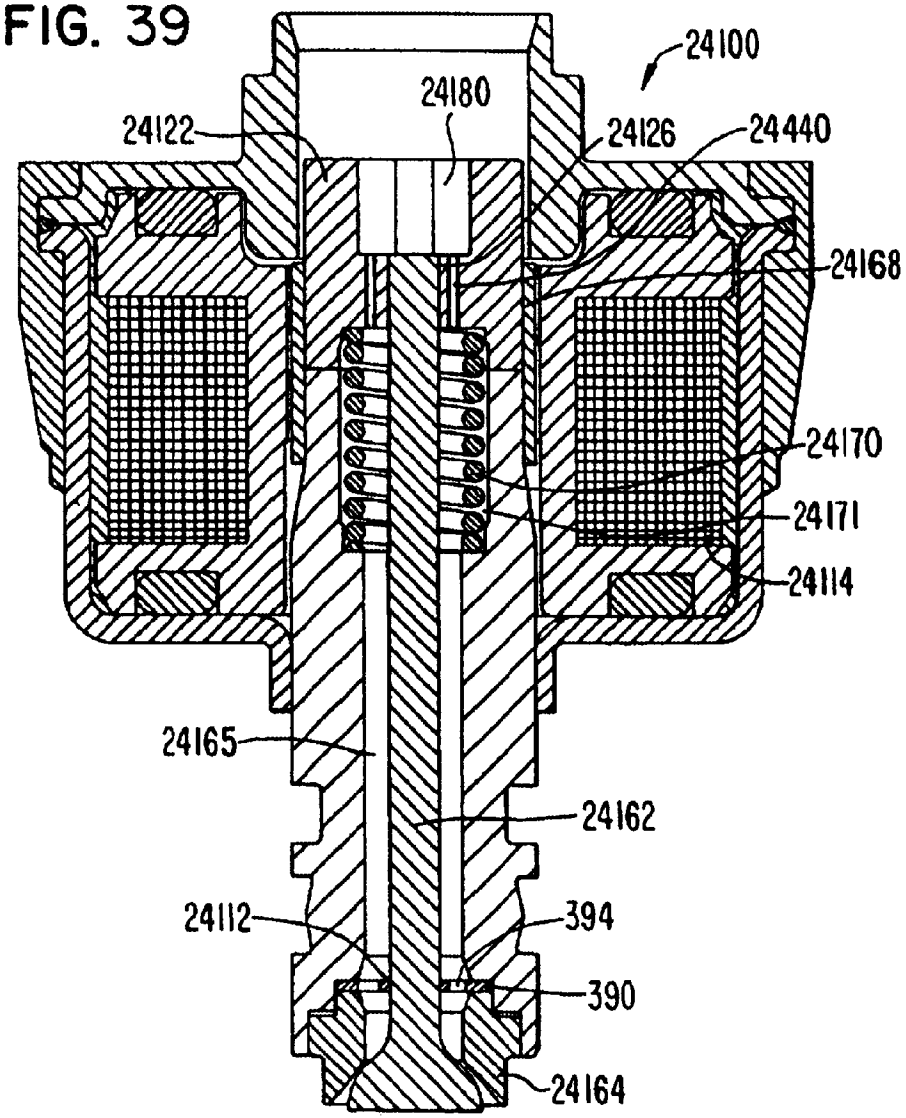
FIG. 39 is a cross-sectional view of the air assist fuel injector illustrated in FIG. 38 taken along the line 39—39 in FIG. 38.
Figure 38:
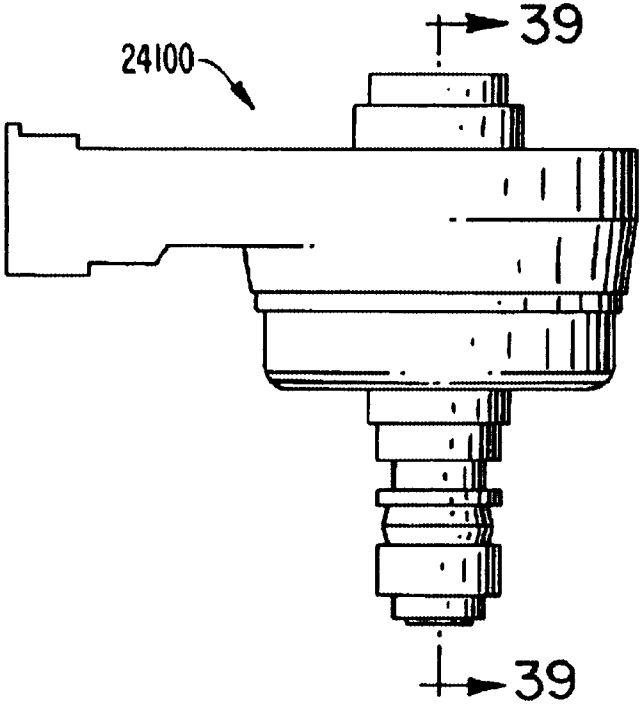
FIG. 38 is a side view of another embodiment of an air assist fuel injector according to the present invention, where the air assist fuel injector includes a solid poppet.

FIGS. 8–21 illustrates alternative embodiments of air assist fuel injectors 1100, 2100, 3100, 4100, 5100, 6100, 7100 each having an insert in accordance with the present invention. Additionally, FIGS. 22–37 illustrate alternative embodiments of valve assemblies 8160, 9160, 10160, 11160, 12160, 13160, 14160, 15160, 16160, 17160, 18160, 19160, 20160, 21160, 22160, 23160 each also having an insert in accordance with the present invention. FIGS. 38 and 39 also illustrate an alternative embodiment of an air assist fuel injector 24100 having an insert and a solid poppet 24162 in accordance with the present invention. The foregoing discussion of the features, functions, and benefits of the air assist fuel injector 100 and valve assembly 160 also applies to the air assist fuel injectors 1100, 2100, 3100, 4100, 5100, 6100, 7100, 24100 and the valve assemblies 8160, 9160, 10160, 11160, 12160, 13160, 14160, 15160, 16160, 17160, 18160, 19160, 20160, 21160, 22160, 23160. Thus, the air assist fuel injectors 1100, 2100, 3100, 4100, 5100, 6100, 7100, 24100 and the valve assemblies 8160, 9160, 10160, 11160, 12160, 13160, 14160, 15160, 16160, 17160, 18160, 19160, 20160, 21160, 22160, 23160 have been assigned corresponding reference numbers as the air assist fuel injector 100 and its valve assembly 160, increased by thousands. As is apparent, the air assist fuel injectors 1100, 2100, 3100, 4100, 5100, 6100, 7100, 24100 and the valve assemblies 8160, 9160, 10160, 11160, 12160, 13160, 14160, 15160, 16160, 17160, 18160, 19160, 20160, 21160, 22160, 23160 include many additional features and inherent functions, as described further below.

Figure 9:
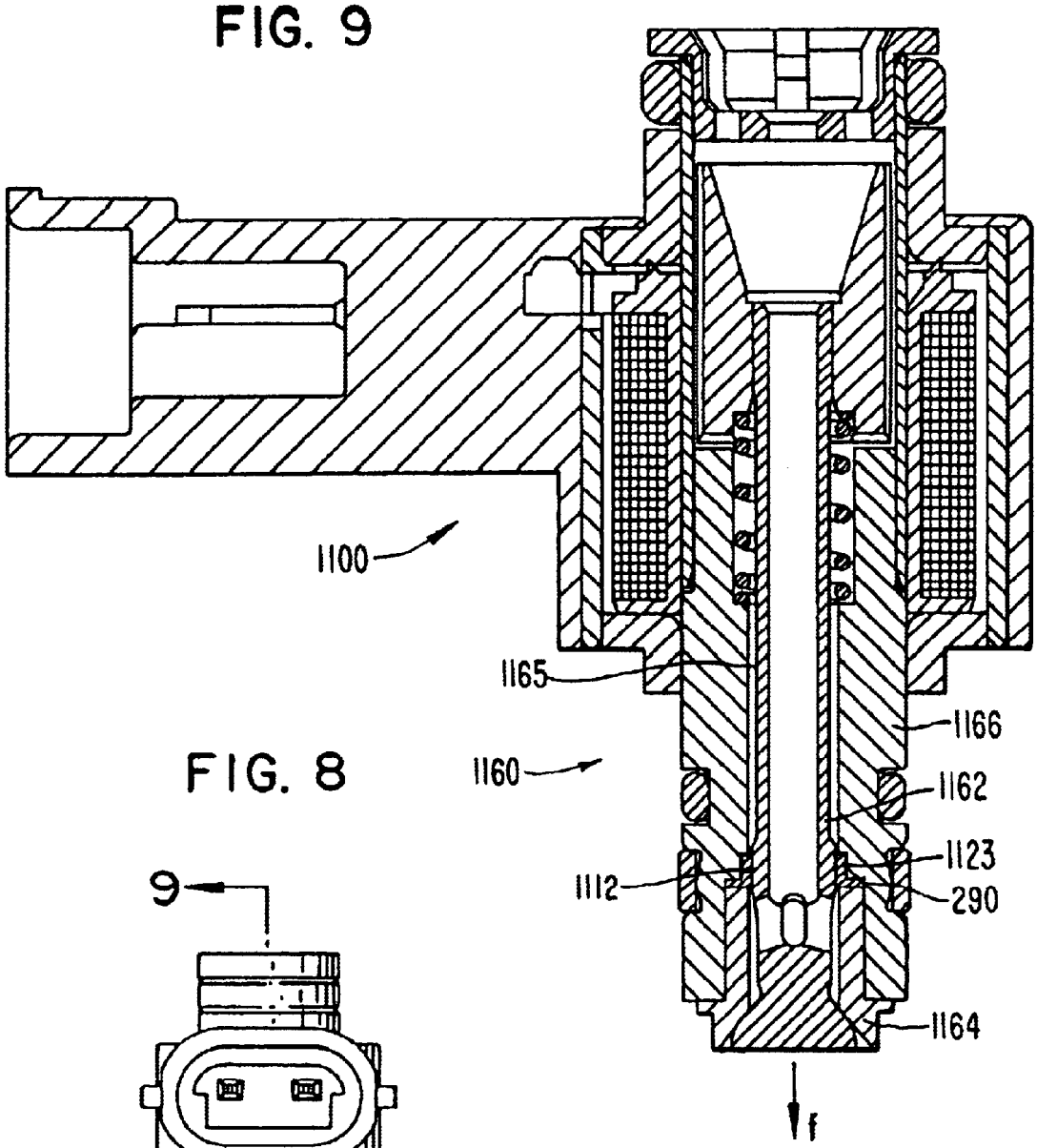
FIG. 9 is a cross-sectional view of the air assist fuel injector illustrated in FIG. 8 taken along the line 9—9 in FIG. 8.
Figure 8:
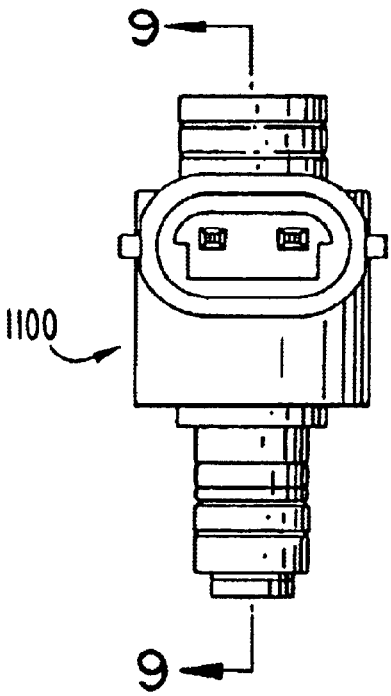
FIG. 8 is a rear view of a first alternative embodiment of an air assist fuel injector according to the present invention.
Figure 42:
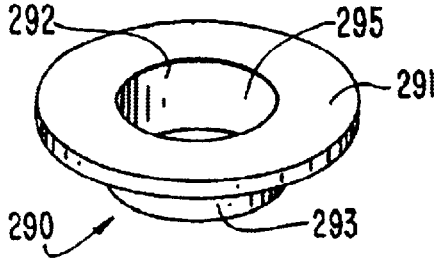
FIG. 42 is a perspective view of a third embodiment of an insert for use with an air assist fuel injector according to the present invention.
Figure 46:
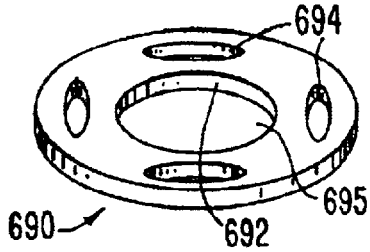
FIG. 46 is a perspective view of a seventh embodiment of an insert for use with an air assist fuel injector according to the present invention.

As illustrated in FIGS. 8 and 9, the air assist fuel injector 1100 is identical to the air assist fuel injector 100 in all respects, except for the insert 290 and the leg 1166. As illustrated in FIG. 42, the insert 290 is a non-planar collar having an annular wall 291 with a lip 293 transversely protruding from one side of the annular wall. The insert 290 has a throughole 295 defined by a surface 292 that slidably engages the bearing surface 1112 of the poppet 1162 to guide movement of the poppet. The throughole 295 passes through the wall 291 and the lip 293. In the illustrated embodiment, the insert 290 is located between opposing faces of the seat 1164 and the leg 1166. Additionally, the channel 1165 includes a stepped bore 1123 that matingly receives the outer cylindrical surface of the lip 293 and a portion of the seat 1164. The lip 293 of the insert 290 is oriented in the upstream direction with respect to the direction of flow f. Because the bearing surface 292 guides the movement of the poppet 1162, the seat 1164 and/or leg 1166 need not be ground to produce a bearing surface therein, thus decreasing the complexity of the valve assembly 1160 and the air assist fuel injector 1100.

Figure 11:
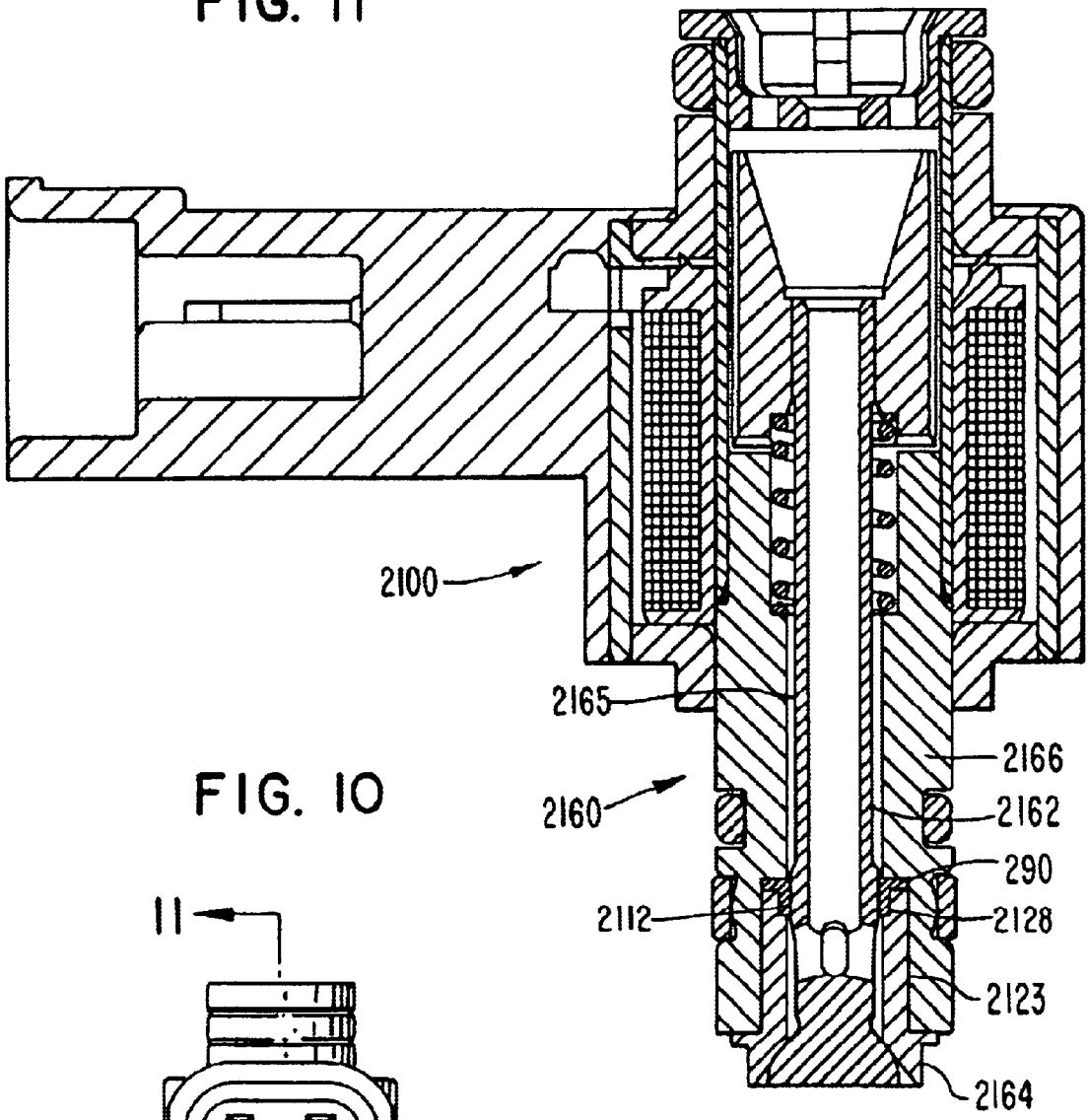
FIG. 11 is a cross-sectional view of the air assist fuel injector illustrated in FIG. 10 taken along the line 11—11 in FIG. 10.
Figure 10:
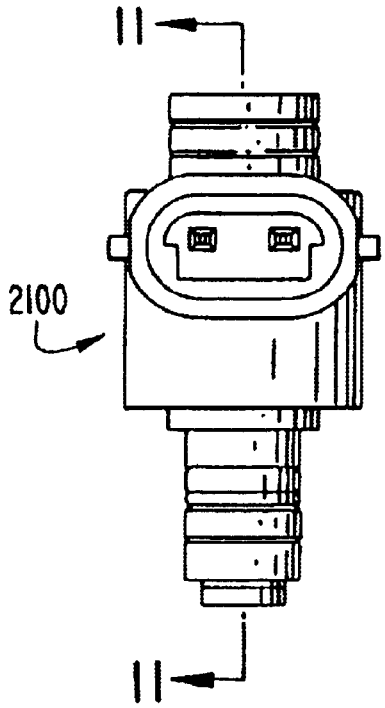
FIG. 10 is a rear view of a second alternative embodiment of an air assist fuel injector according to the present invention.

As illustrated in FIGS. 10 and 11, the air assist fuel injector 2100 is identical to the air assist fuel injector 100 in all respects, except for the insert 290 and the seat 2164. In the illustrated embodiment, the insert 290 is located between opposing faces of the seat 2164 and the leg 2166. The channel 2165 includes an enlarged bore 2123 that receives the insert 290 and the seat 2164. The seat 2164 also includes a recess 2128 in a distal or upstream end of the seat that matingly receives the outer cylindrical surface of the lip 293. Hence, the lip 293 of the insert 290 is oriented in the downstream direction with respect to the direction of flow f. Because the bearing surface 292 of the insert 290 slidably engages the bearing surface 2165 to guide the movement of the poppet 2162, the seat 2164 and/or the leg 2166 need not be ground to produce a bearing surface therein, thus decreasing the complexity of the valve assembly 2160 and the air assist fuel injector 2100.

Figure 13:
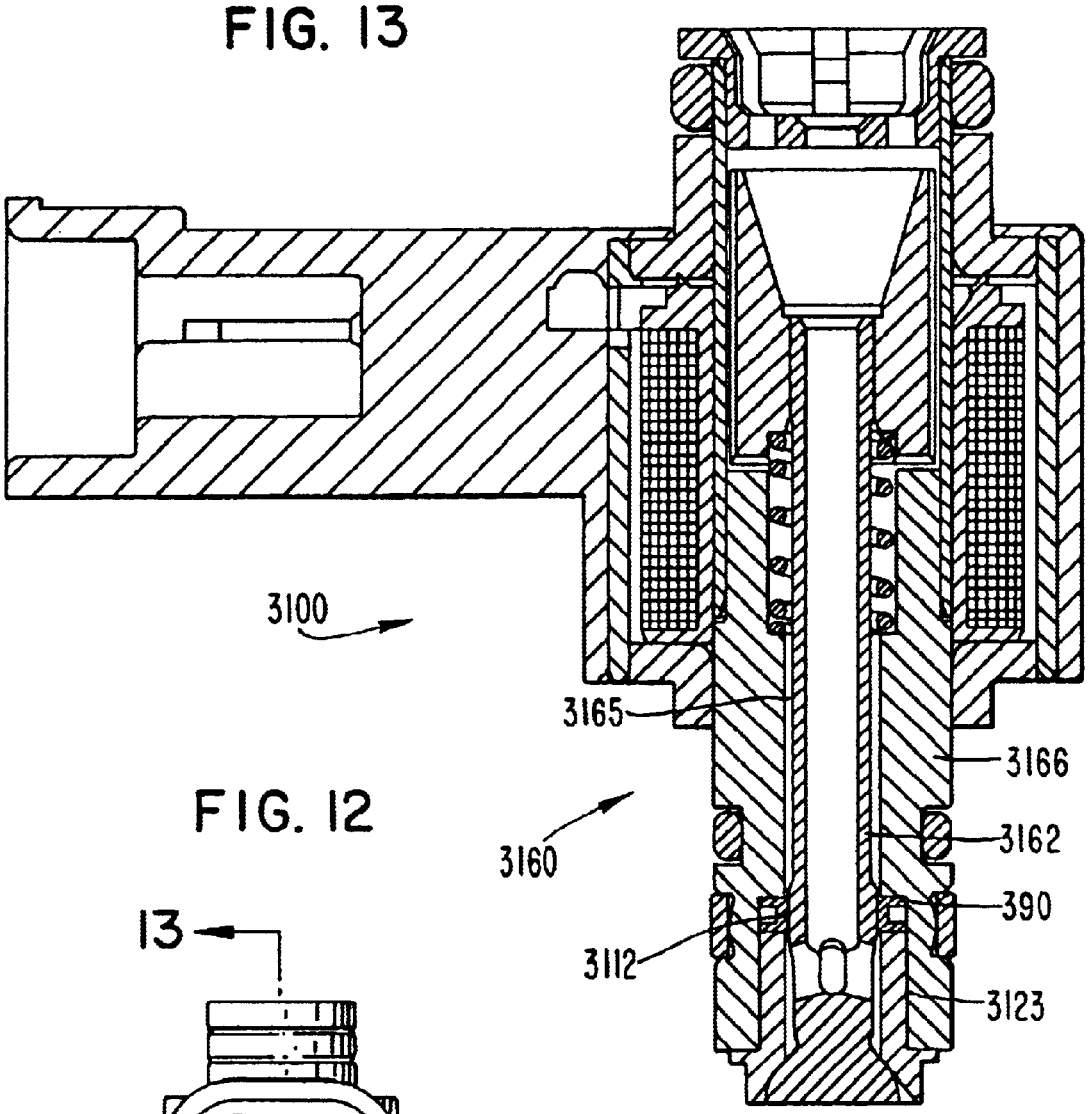
FIG. 13 is a cross-sectional view of the air assist fuel injector illustrated in FIG. 12 taken along the line 13—13 in FIG. 12.
Figure 12:
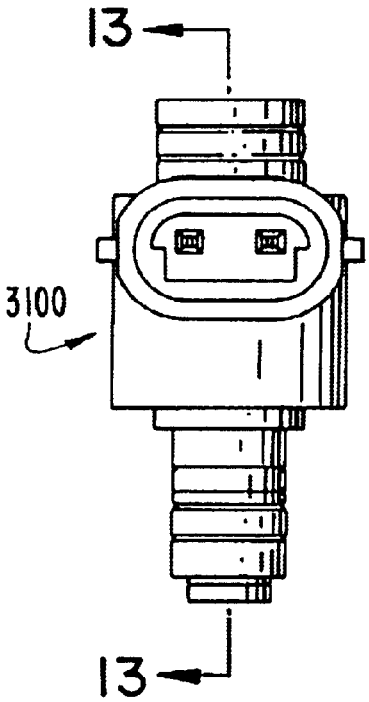
FIG. 12 is a rear view of a third alternative embodiment of an air assist fuel injector according to the present invention.
Figure 41:
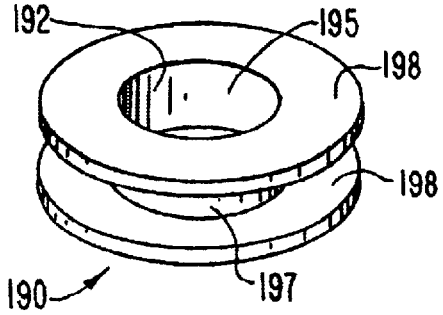
FIG. 41 is a perspective view of a second embodiment of an insert for use with an air assist fuel injector according to the present invention.
Figure 45:
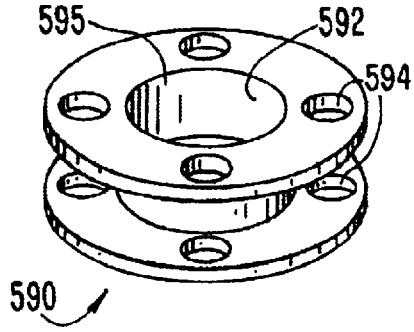
FIG. 45 is a perspective view of a sixth embodiment of an insert for use with an air assist fuel injector according to the present invention.

As illustrated in FIGS. 12 and 13, the air assist fuel injector 3100 is identical to the air assist fuel injector 100 in all respects, except for the insert 190. As illustrated in FIG. 41, the insert 190 is a spool-shaped member having a cylindrical wall 197 located between two annular walls 198. The insert 190 has a throughole 195 defined by a cylindrical surface 192 that slidably engages the bearing surface 3112 of the poppet 3162 to guide movement of the poppet. The throughole 195 passes through the annular walls 198 and the cylindrical wall 197. In the illustrated embodiment, the insert 190 is received by an enlarged bore 3123 of the channel 3165 and is located between opposing faces of the seat 3164 and the leg 3166. Because the bearing surface 192 guides movement of the poppet 3162, the seat 3164 and/or leg 3166 need not ground to produce a bearing surface therein, thus decreasing the complexity of the valve assembly 3160 and the air assist fuel injector 3100.

Figure 15:
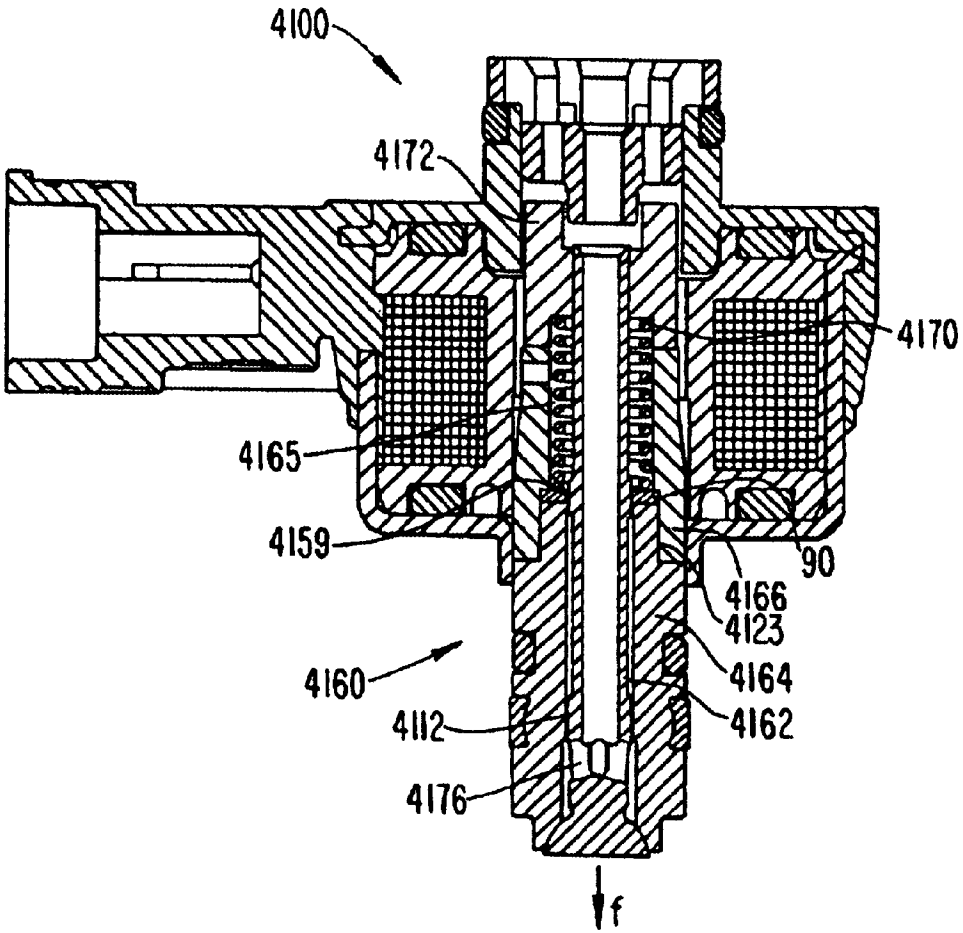
FIG. 15 is a cross-sectional view of the air assist fuel injector illustrated in FIG. 14 taken along the line 15—15 in FIG. 14.
Figure 14:
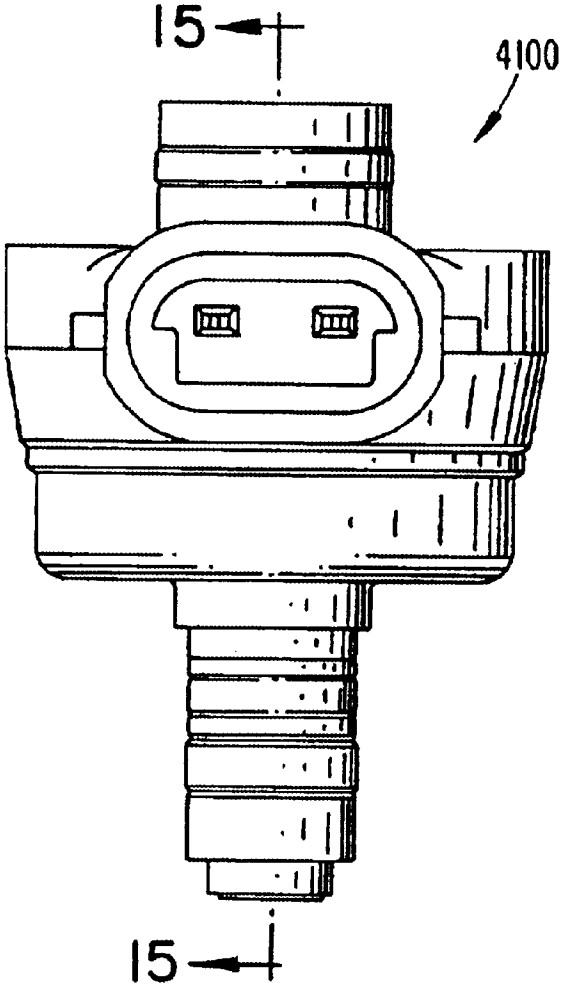
FIG. 14 is a rear view of a fourth alternative embodiment of an air assist fuel injector according to the present invention.

As illustrated in FIGS. 14 and 15, the air assist fuel injector 4100 is identical to the air assist fuel injector 100 in many respects, primarily except for the location of the insert 90, the absence of the sleeve 168, and the configuration of the leg 4166 and seat 4164. As illustrated in FIG. 15, the air assist fuel injector 4100 does not include a sleeve 168 that guides movement of the armature 4172 of the valve assembly 4160. Hence, the poppet 4162 of the air assist fuel injector 4100 includes a stem having two bearing surfaces 4112, 4159 that guide the movement of the poppet 4162. The first bearing surface 4112 is located immediately upstream of the outlet 4176 with respect to the direction of flow f and, as illustrated in FIG. 15, is in contact with a bearing surface of the seat 4164. The second bearing surface 4159 of the poppet 4162 is located upstream of the first bearing surface 4112 with respect to the direction of flow f and is in sliding engagement with the insert 90. The bearing surface 92 of the insert 90 slidably engages the bearing surface 4159 of the poppet 4162 to guide movement of the poppet. In the illustrated embodiment, the insert 90 is located between opposing faces of the seat 4164 and the leg 4166. Additionally, the channel 4165 of the leg 4166 includes an enlarged bore 4123 that matingly receives the outer cylindrical surface of the insert 90 and a portion of the seat 4164. As is also illustrated in FIG. 15, the downstream portion of the spring 4170 abuts against the upstream face of the insert 90. Because the bearing surface 92 of the insert 90 guides movement of the poppet 4162 at the bearing surface 4159, the seat 4164 and/or leg 4166 need not include an additional ground bearing surface therein, thus decreasing the complexity of the valve assembly 4160 and the air assist fuel injector 4100.

Figure 17:
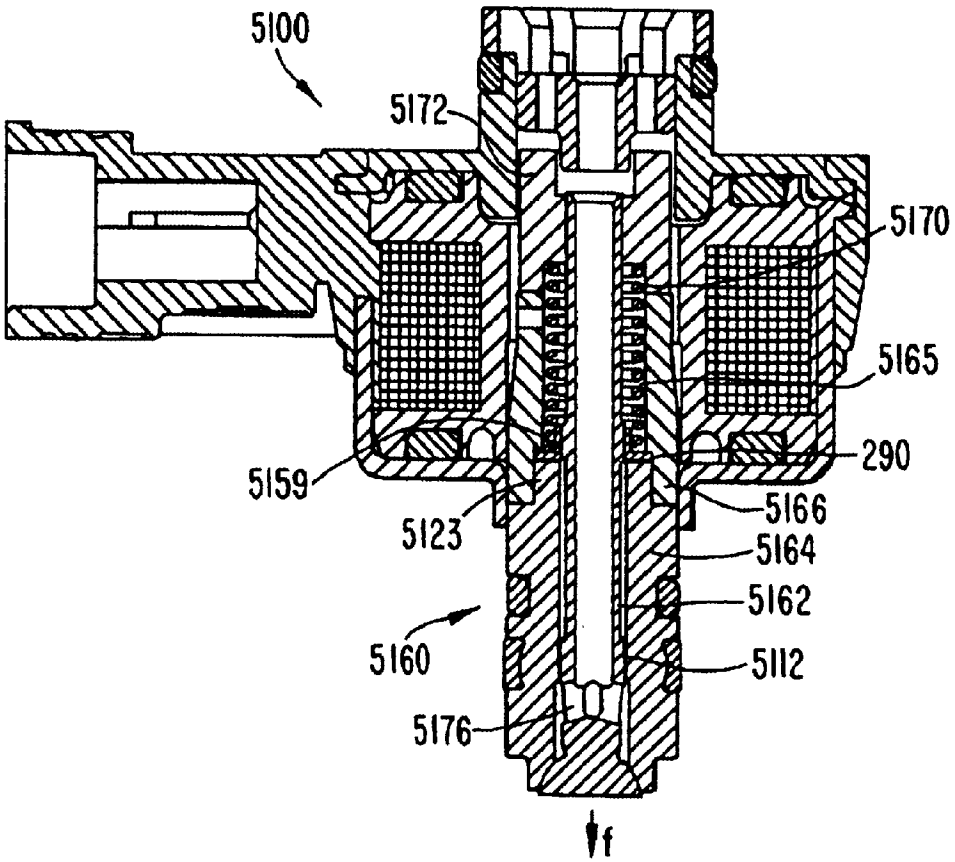
FIG. 17 is a cross-sectional view of the air assist fuel injector illustrated in FIG. 16 taken along the line 17—17 in FIG. 16.
Figure 16:
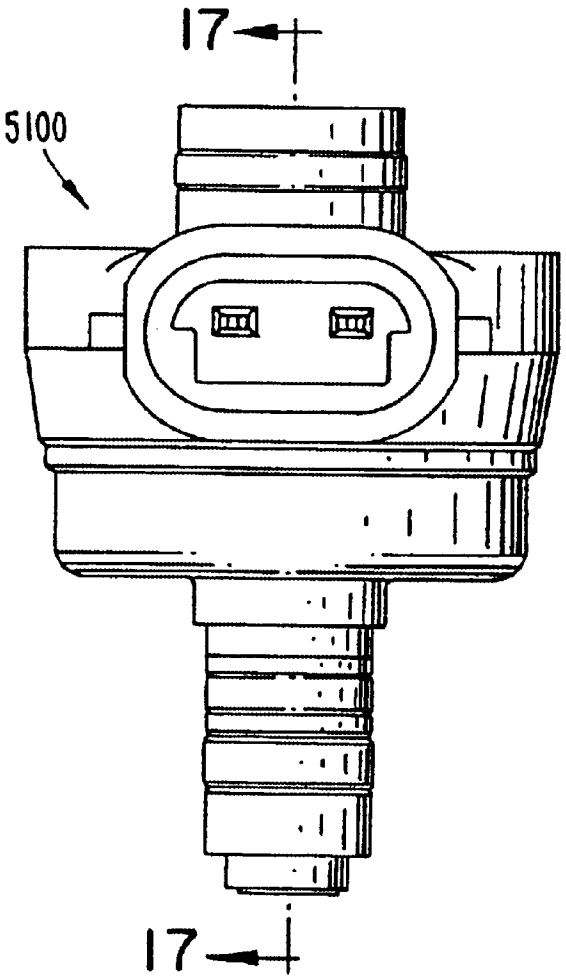
FIG. 16 is a rear view of a fifth alternative embodiment of an air assist fuel injector according to the present invention.

As is illustrated in FIGS. 16 and 17, the air assist fuel injector 5100 is identical to the air assist fuel injector 4100 in all respects, except for the insert 290. As illustrated in FIG. 17, the insert 290 slidably engages the bearing surface 5159 of the poppet 5162 to guide movement of the poppet, and the insert 290 is located between opposing faces of the seat 5164 and the leg 5166. Additionally, the portion of the channel 5165 that receives the spring 5170 also receives the lip 293 of the insert 290. Hence, the lip 293 of the insert 290 is oriented in the upstream direction with respect to the direction of flow f. Because the bearing surface 292 guides movement of the poppet 5162 at the bearing surface 5159 of the poppet, the seat 5164 and/or leg 5166 need not be ground to produce an additional bearing surface therein, thus decreasing the complexity of the valve assembly 5160 and the air assist fuel injector 5100.

Figure 19:
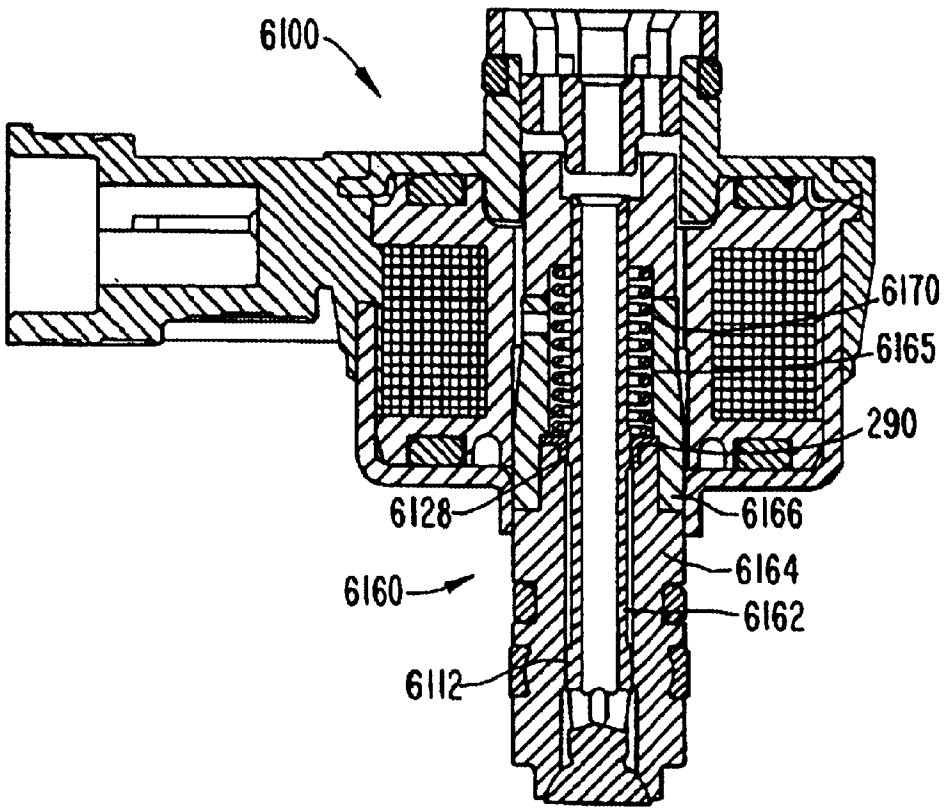
FIG. 19 is a cross-sectional view of the air assist fuel injector illustrated in FIG. 18 taken along the line 19—19 in FIG. 18.
Figure 18:
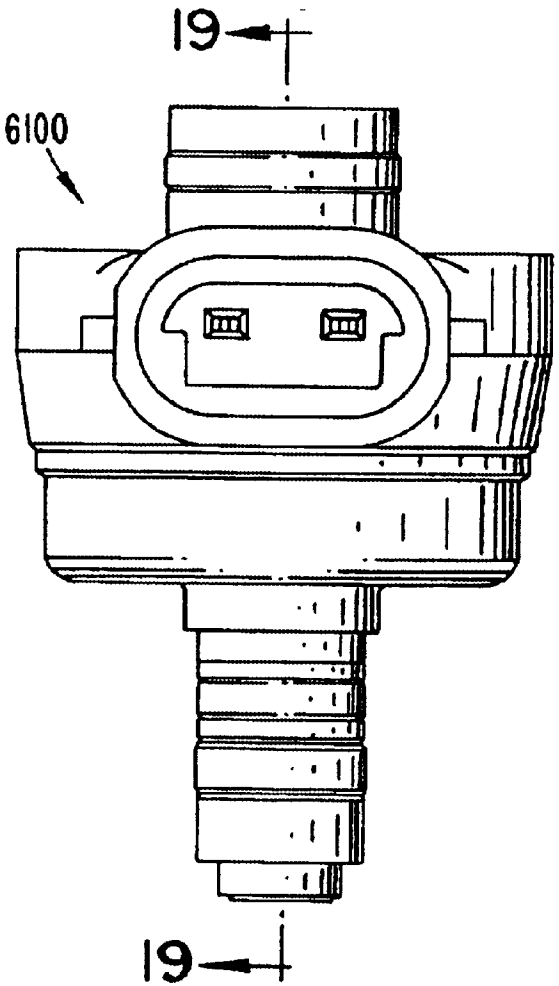
FIG. 18 is a rear view of a sixth alternative embodiment of an air assist fuel injector according to the present invention.

As illustrated in FIGS. 18 and 19, the air assist fuel injector 6100 is identical to the air assist fuel injector 4100 in all respects except for the insert 290 and the seat 6164. The bearing surface 292 of the insert 290 slidably engages the bearing surface 6159 of the poppet 6162 to guide movement of the poppet. As illustrated in FIG. 19, the seat 6164 includes a recess 6128 that matingly receives the outer cylindrical surface of the lip 293 of the insert 290. Hence, the lip 293 of the insert is oriented in the downstream direction with respect to the direction of flow f. Because the bearing surface 292 guides movement of the poppet, the seat 6164 and/or leg 6166 need not include an additional ground bearing surface therein, thus decreasing the complexity of the valve assembly 6160 and the air assist fuel injector 6100.

Figure 21:
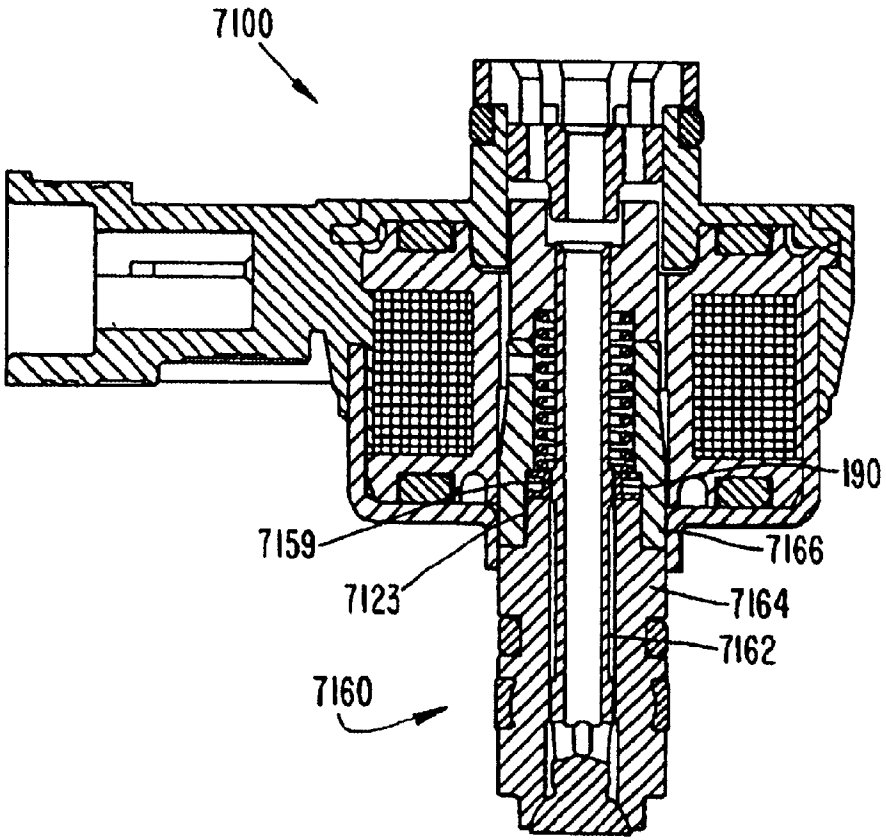
FIG. 21 is a cross-sectional view of the air assist fuel injector illustrated in FIG. 20 taken along the line 21—21 in FIG. 20.
Figure 20:
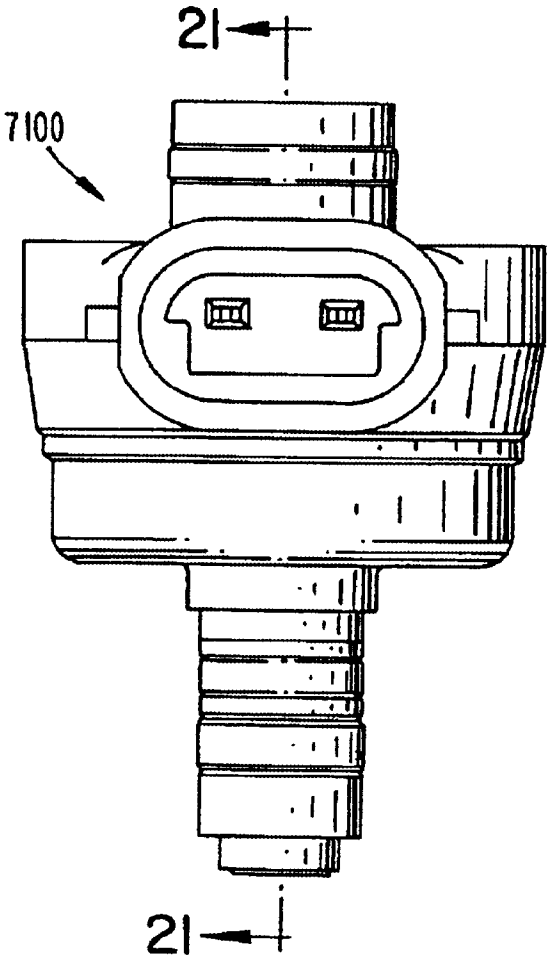
FIG. 20 is a rear view of a seventh alternative embodiment of an air assist fuel injector according to the present invention.

As illustrated in FIGS. 20 and 21, the air assist fuel injector 7100 is identical to the air assist fuel injector 4100 in all respects, except for the insert 190. The bearing surface 192 of the insert 190 slidably engages the bearing surface 7159 of the poppet 7162 to guide movement of the poppet. In the illustrated embodiment, the spool-shaped insert 190 is located between opposing faces of the seat 7164 and the leg 7166. Additionally, the leg 7166 includes an enlarged bore 7123 that receives the outer cylindrical surface of the annular walls 198 of the insert 190. Because the bearing surface 192 of the insert 190 guides the movement of the poppet 7162 at the bearing surface 7159, the seat 7164 and/or the leg 7166 need not include an additional ground bearing surface therein, thus decreasing the complexity of the valve assembly 7160 and the air assist fuel injector 7100.

FIGS. 22–37 illustrate alternative embodiments of valve assemblies 8160, 9160, 10160, 11160, 12160, 13160, 14160, 15160, 16160, 17160, 18160, 19160, 20160, 21160, 22160, 23160 of the air assist fuel injectors described herein as well as other air assist fuel injectors, as will be appreciated.

Figure 22:
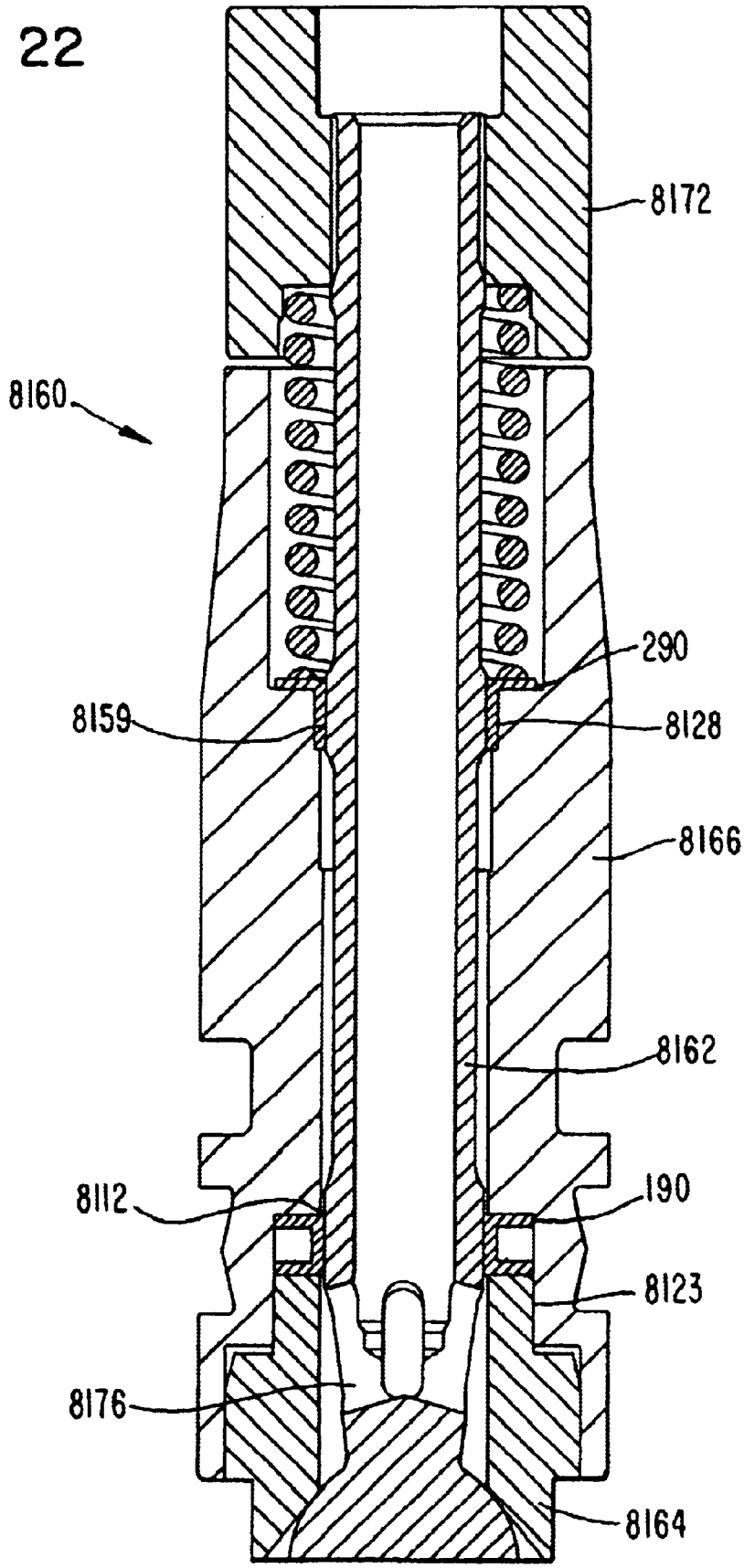
FIG. 22 is a cross-sectional view of a first alternative embodiment of a valve assembly of an air assist fuel injector according to the present invention.
Figure 23:
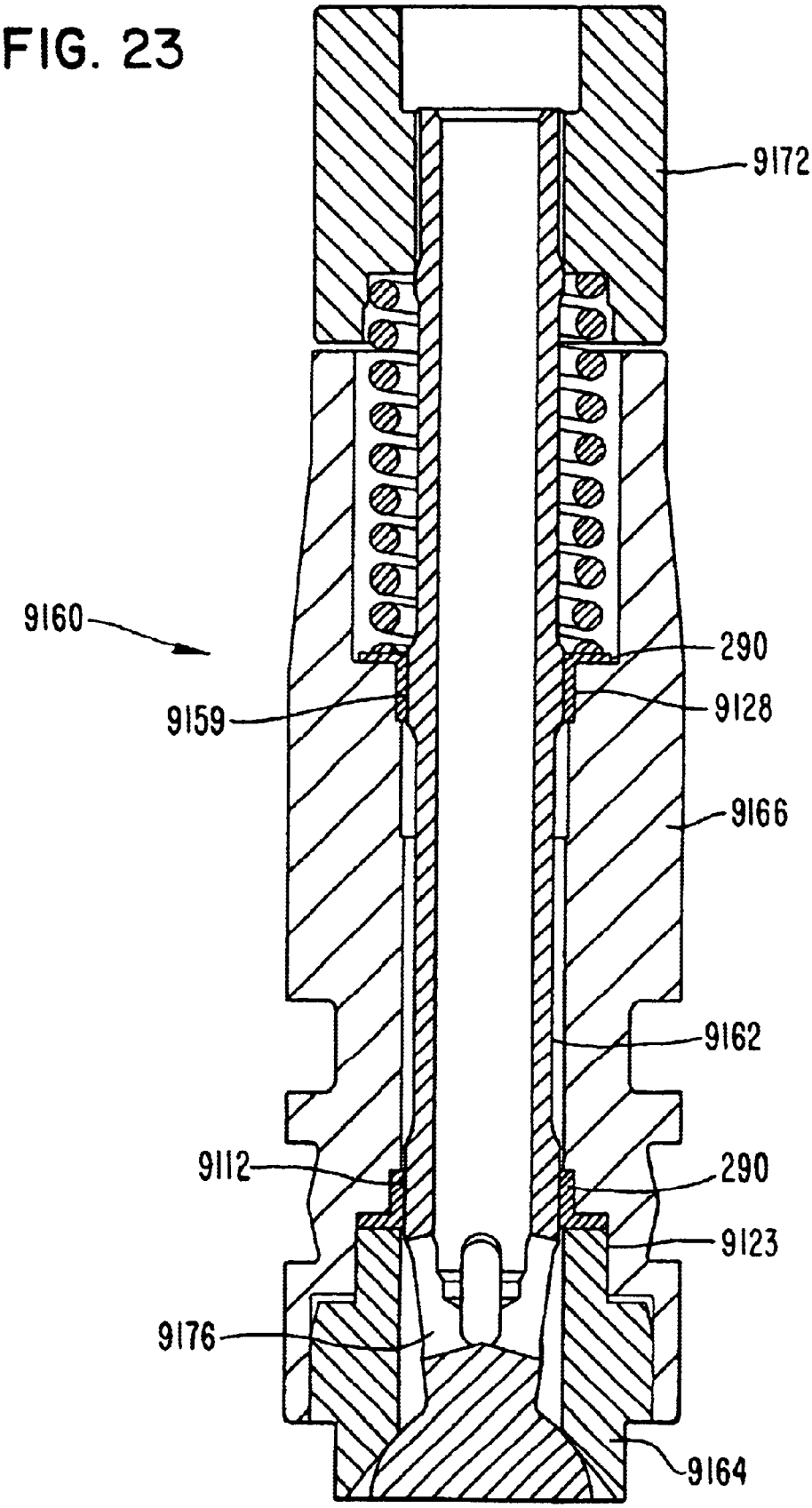
FIG. 23 is a cross-sectional view of a second alternative embodiment of a valve assembly of an air assist fuel injector according to the present invention.
Figure 24:
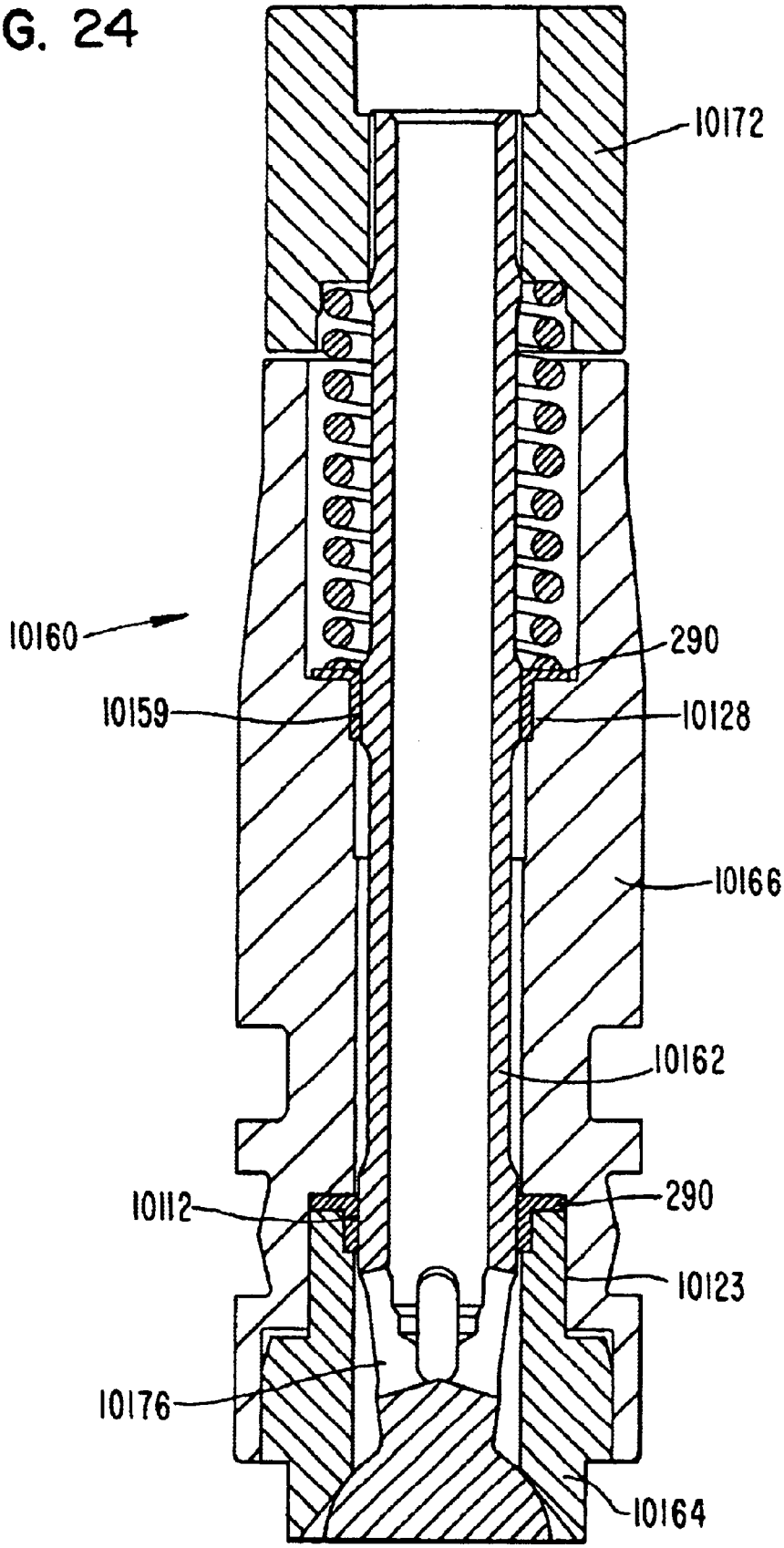
FIG. 24 is a cross-sectional view of a third alternative embodiment of a valve assembly of an air assist fuel injector according to the present invention.
Figure 25:
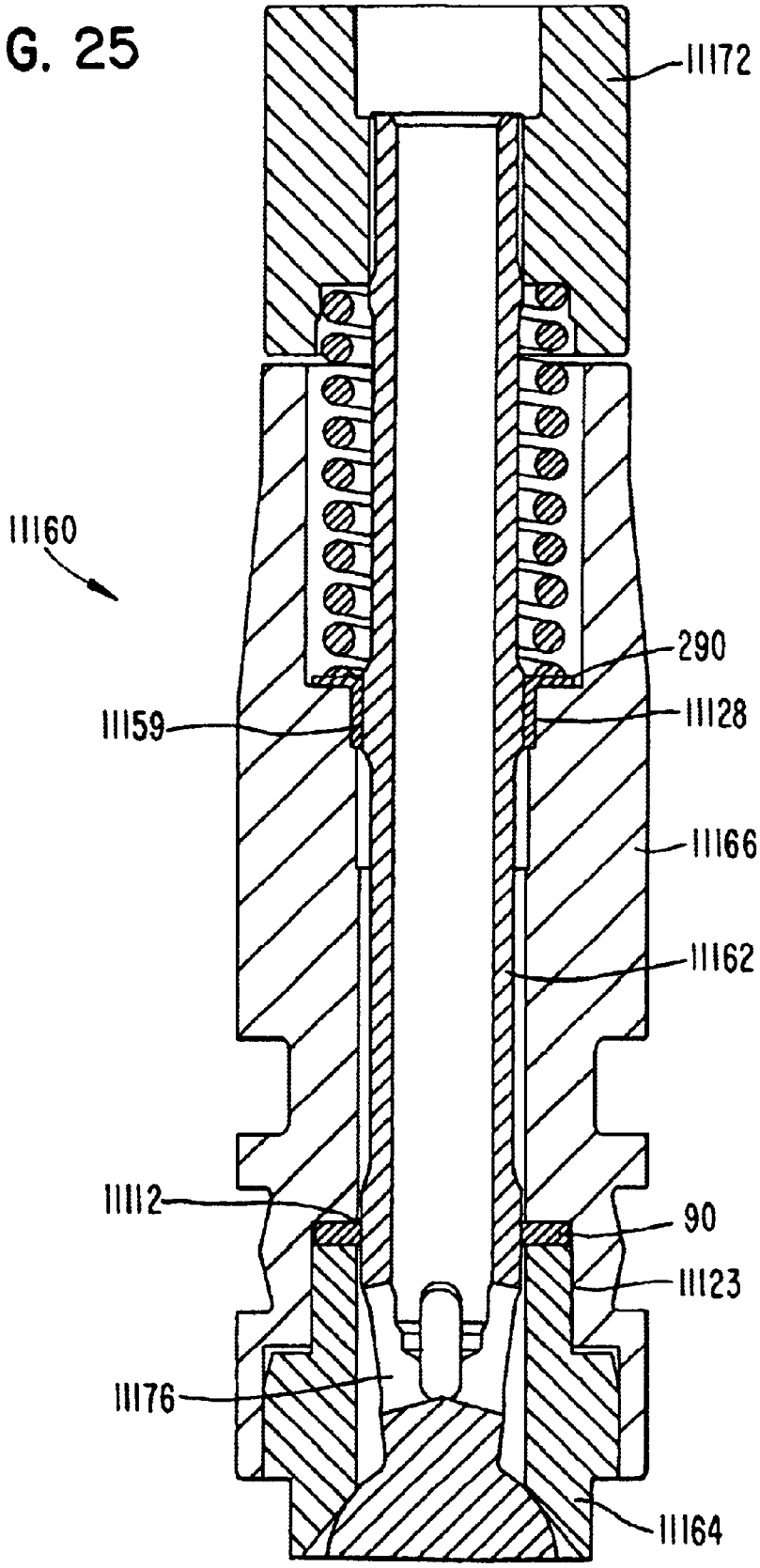
FIG. 25 is a cross-sectional view of a fourth alternative embodiment of a valve assembly of an air assist fuel injector according to the present invention.
Figure 26:
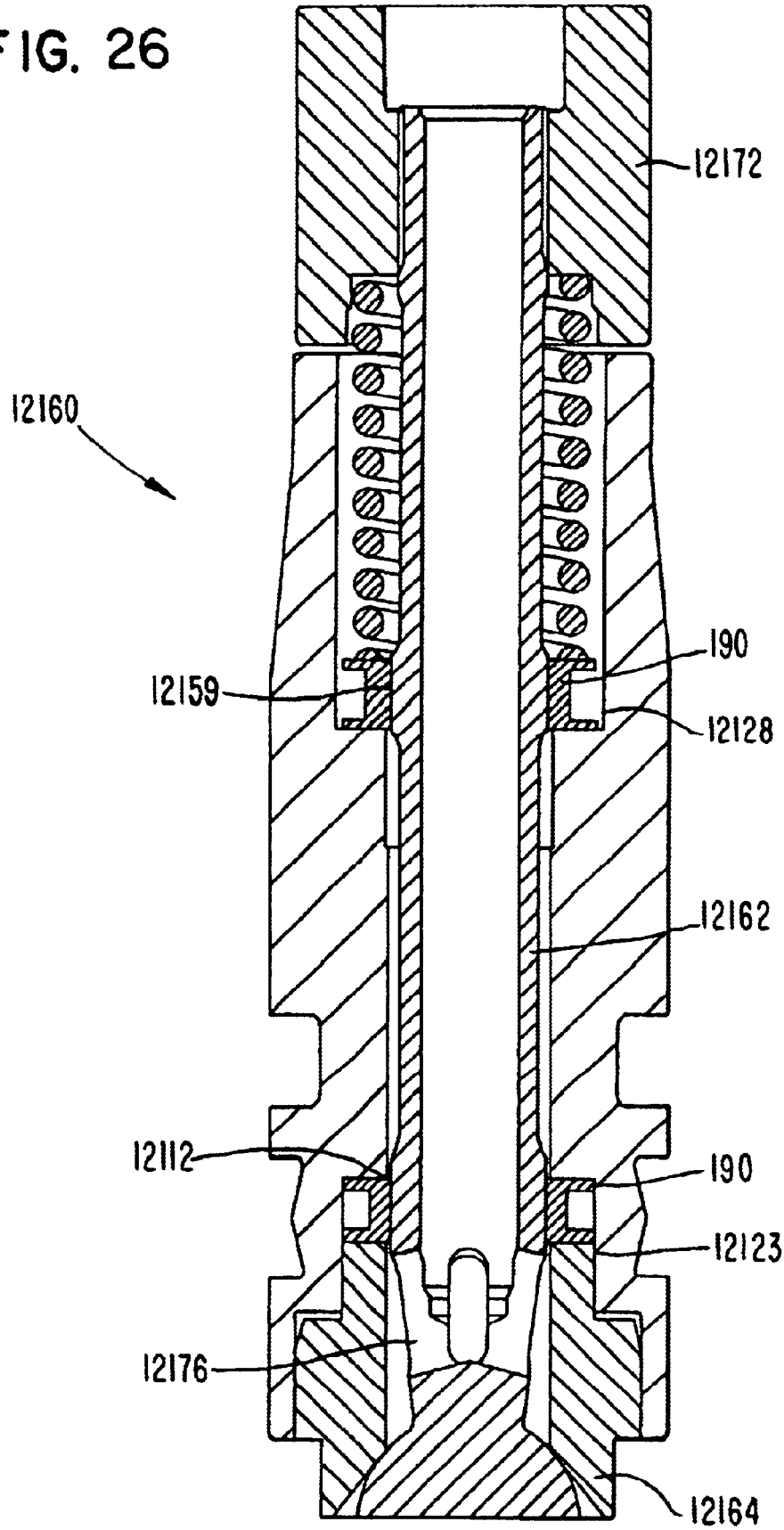
FIG. 26 is a cross-sectional view of a fifth alternative embodiment of a valve assembly of an air assist fuel injector according to the present invention.
Figure 27:
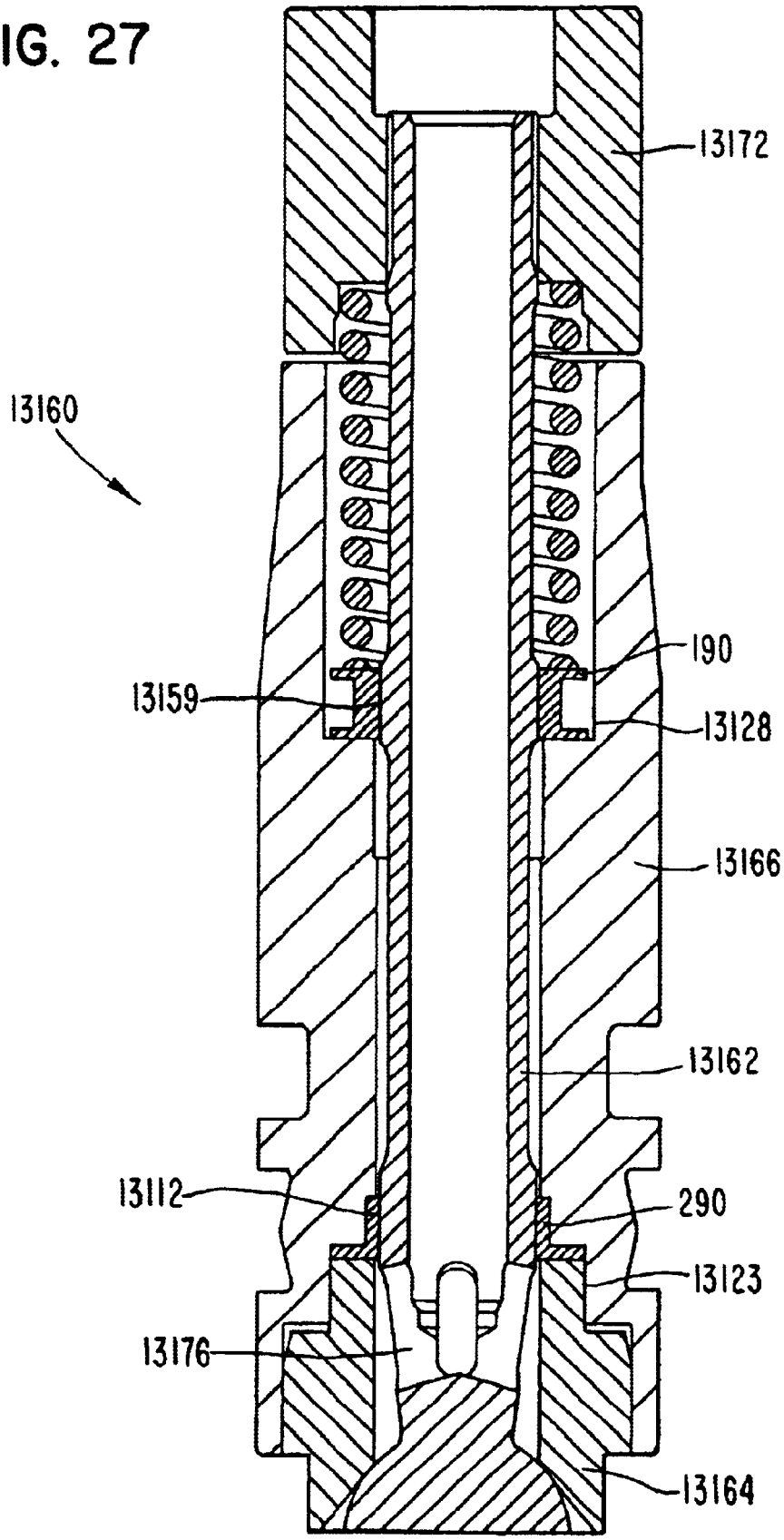
FIG. 27 is a cross-sectional view of a sixth alternative embodiment of a valve assembly of an air assist fuel injector according to the present invention.
Figure 28:
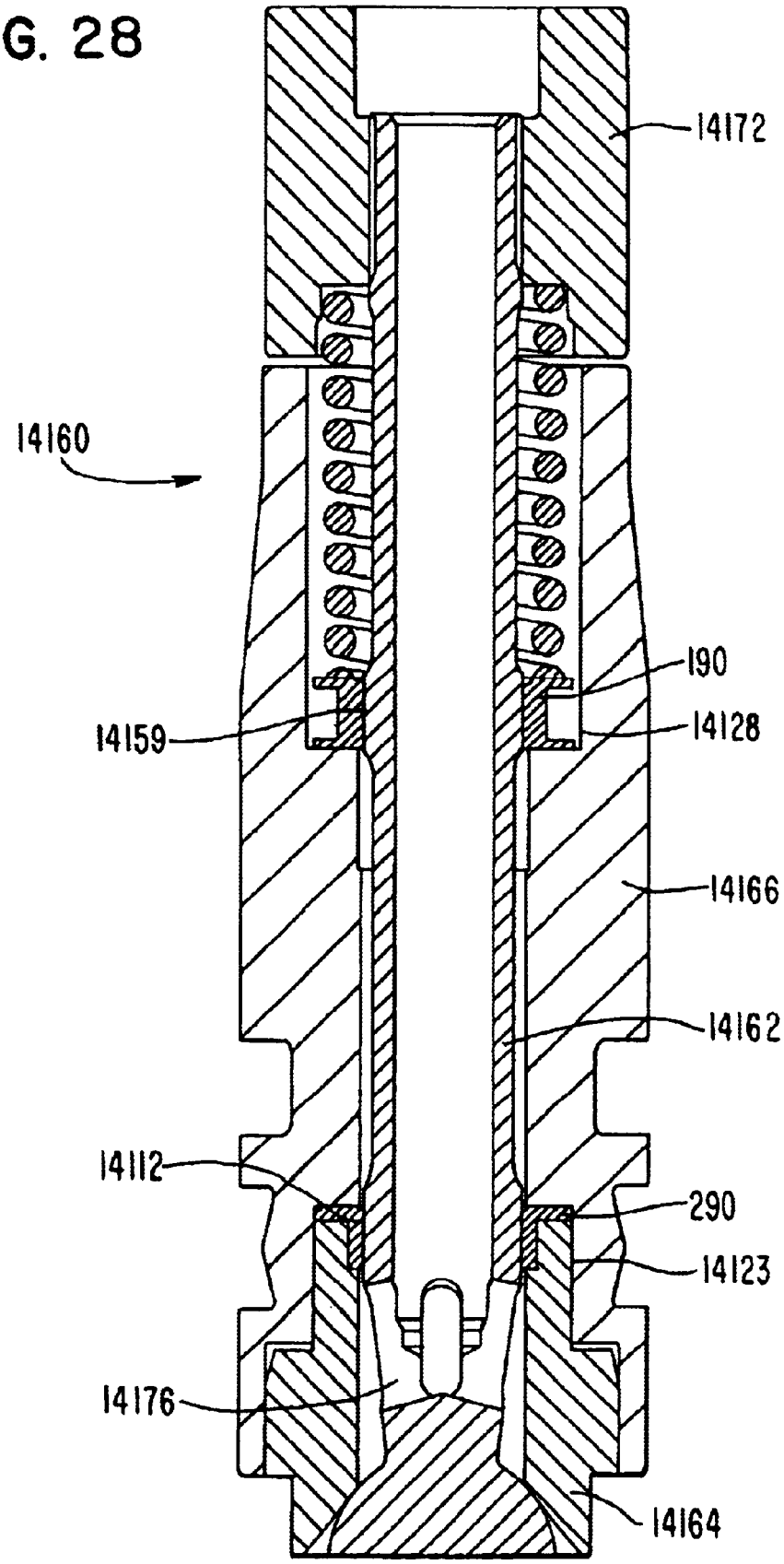
FIG. 28 is a cross-sectional view of a seventh alternative embodiment of a valve assembly of an air assist fuel injector according to the present invention.
Figure 29:
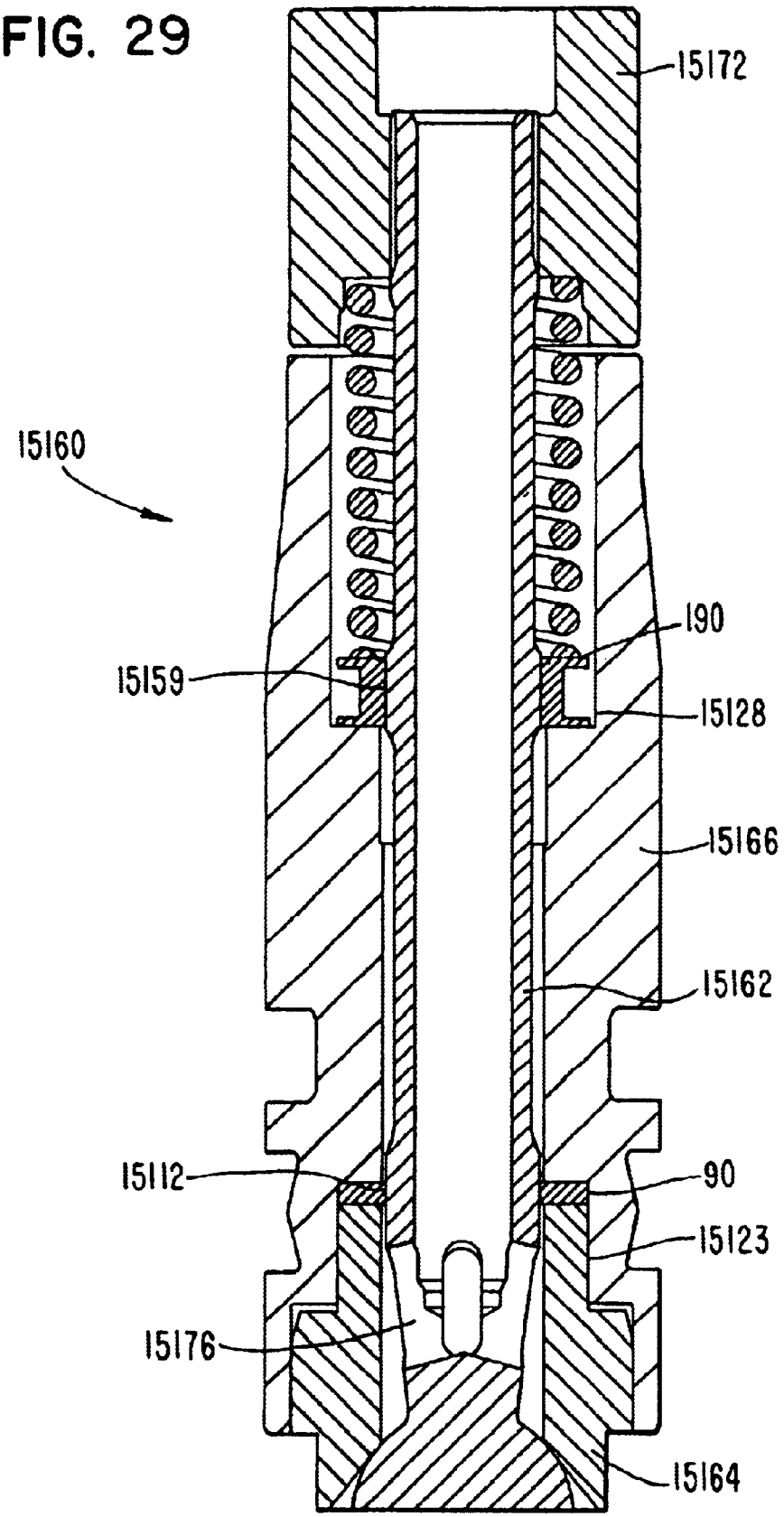
FIG. 29 is a cross-sectional view of a eighth alternative embodiment of a valve assembly of an air assist fuel injector according to the present invention.
Figure 30:
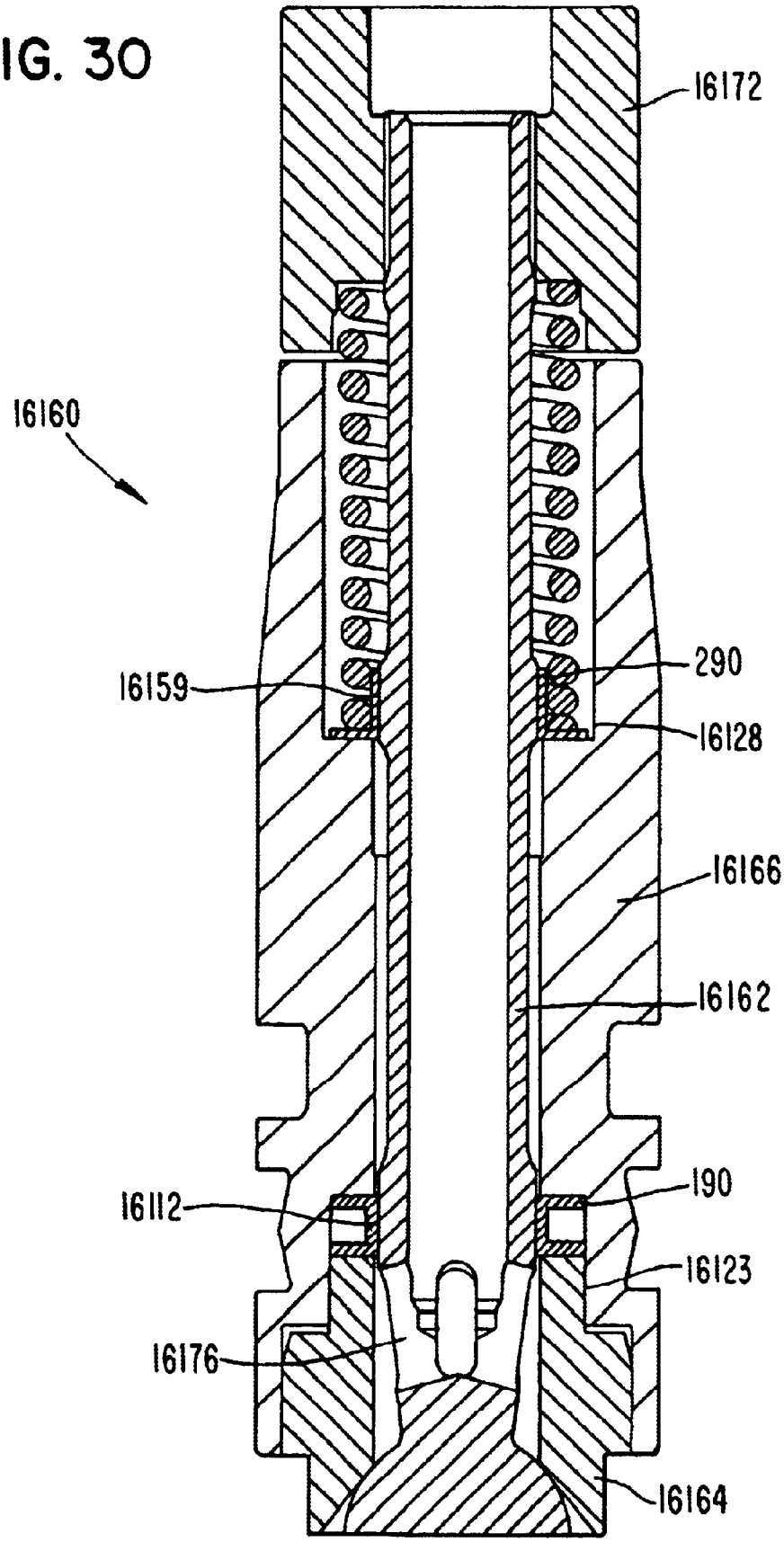
FIG. 30 is a cross-sectional view of a ninth alternative embodiment of a valve assembly of an air assist fuel injector according to the present invention.
Figure 31:
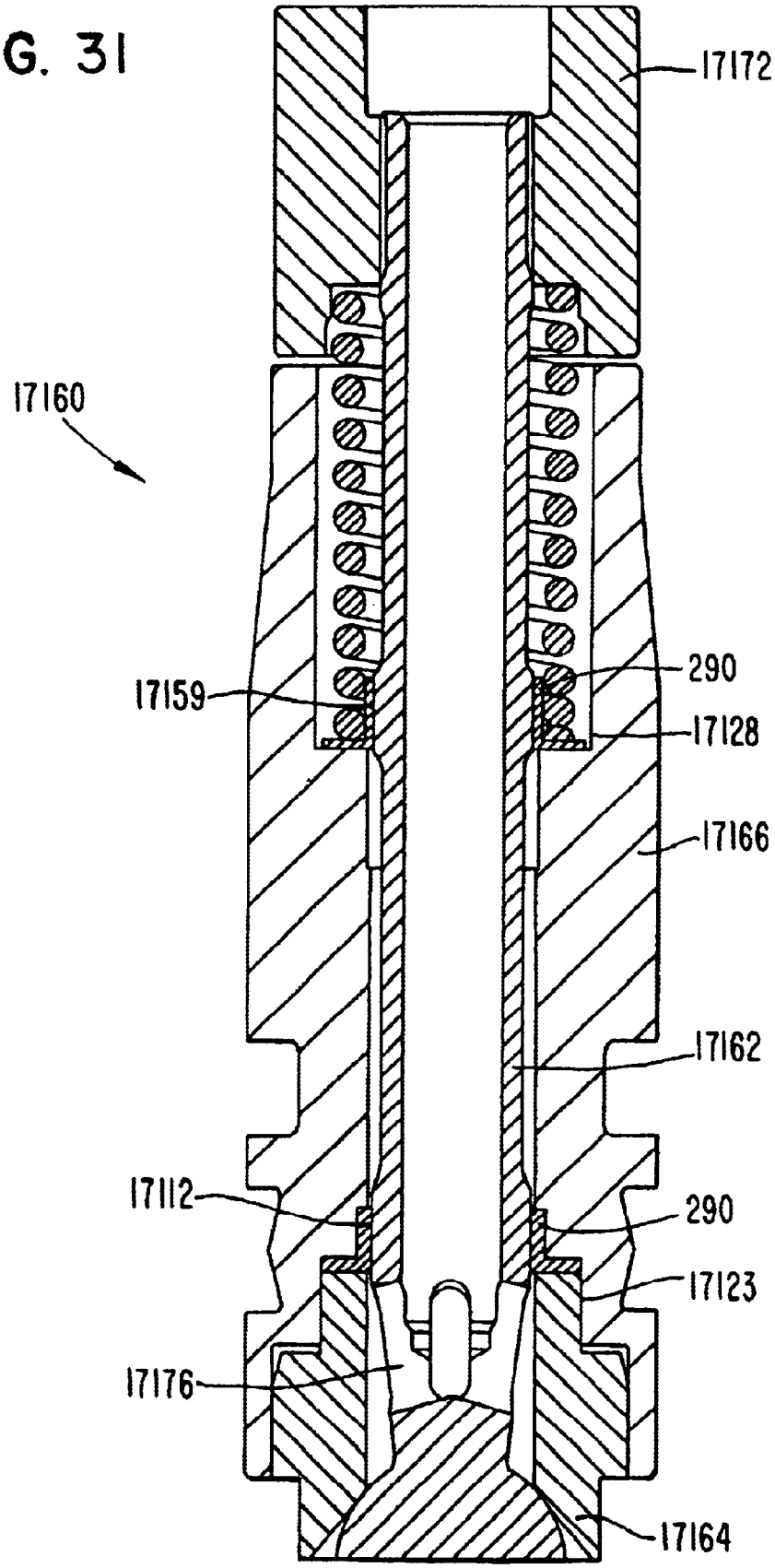
FIG. 31 is a cross-sectional view of a tenth alternative embodiment of a valve assembly of an air assist fuel injector according to the present invention.
Figure 32:
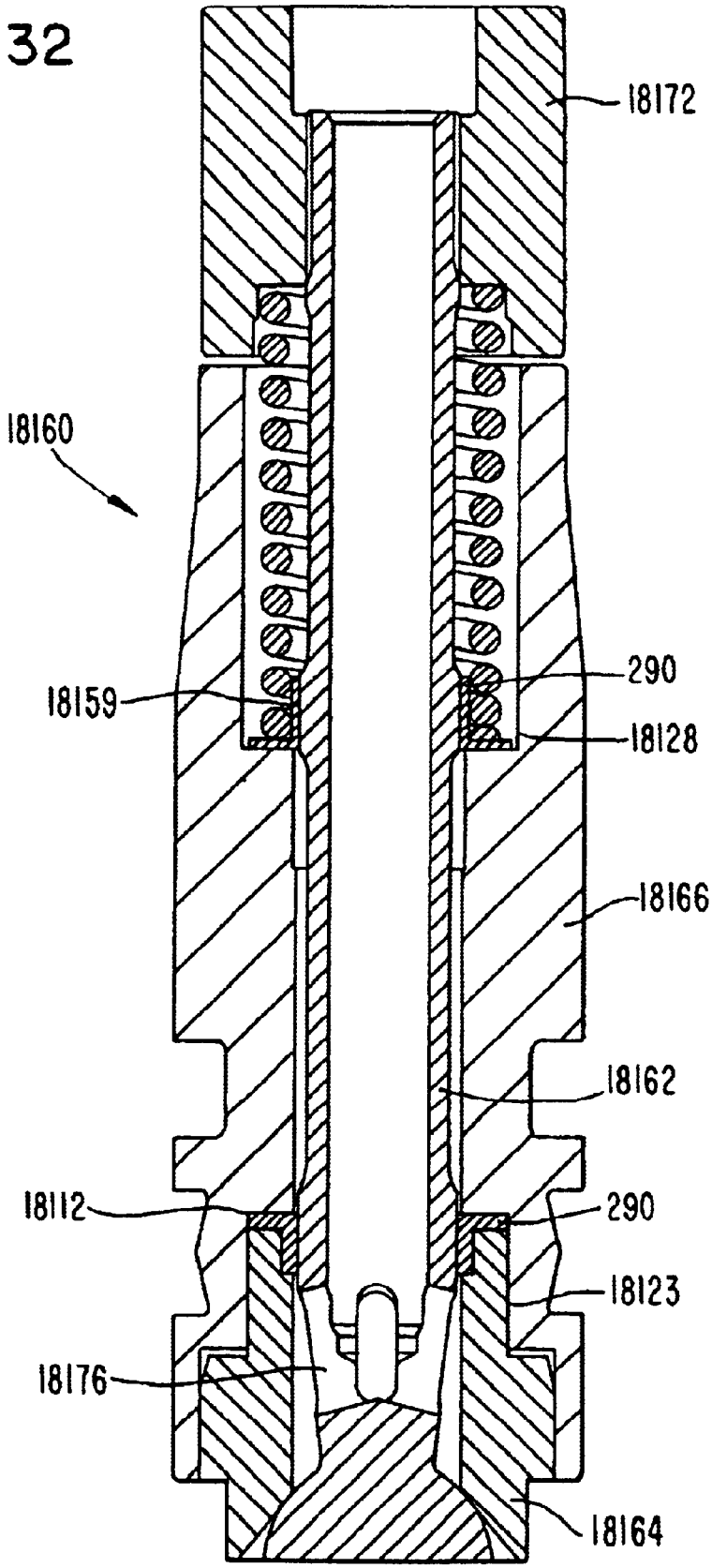
FIG. 32 is a cross-sectional view of a eleventh alternative embodiment of a valve assembly of an air assist fuel injector according to the present invention.
Figure 33:
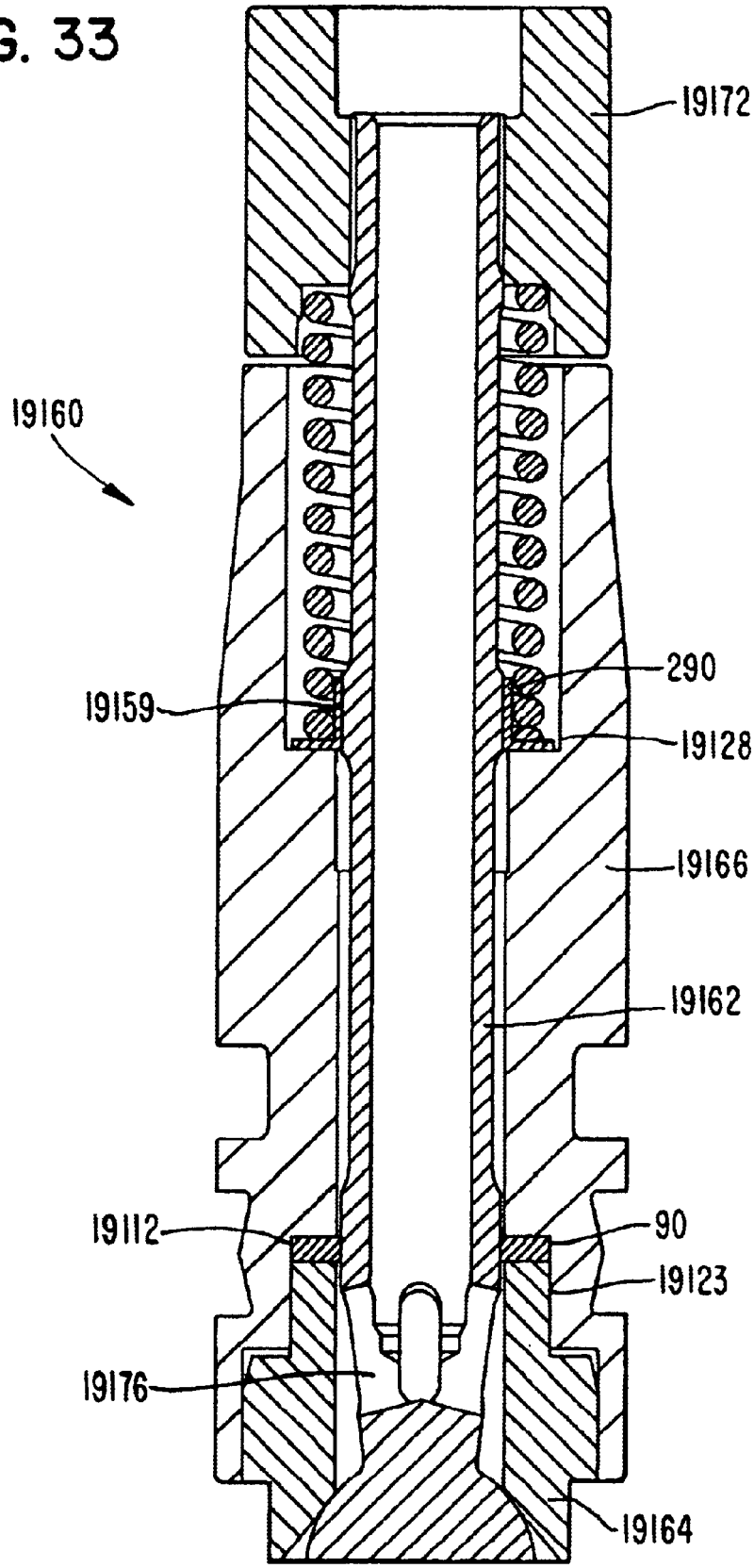
FIG. 33 is a cross-sectional view of a twelfth alternative embodiment of a valve assembly of an air assist fuel injector according to the present invention.
Figure 34:
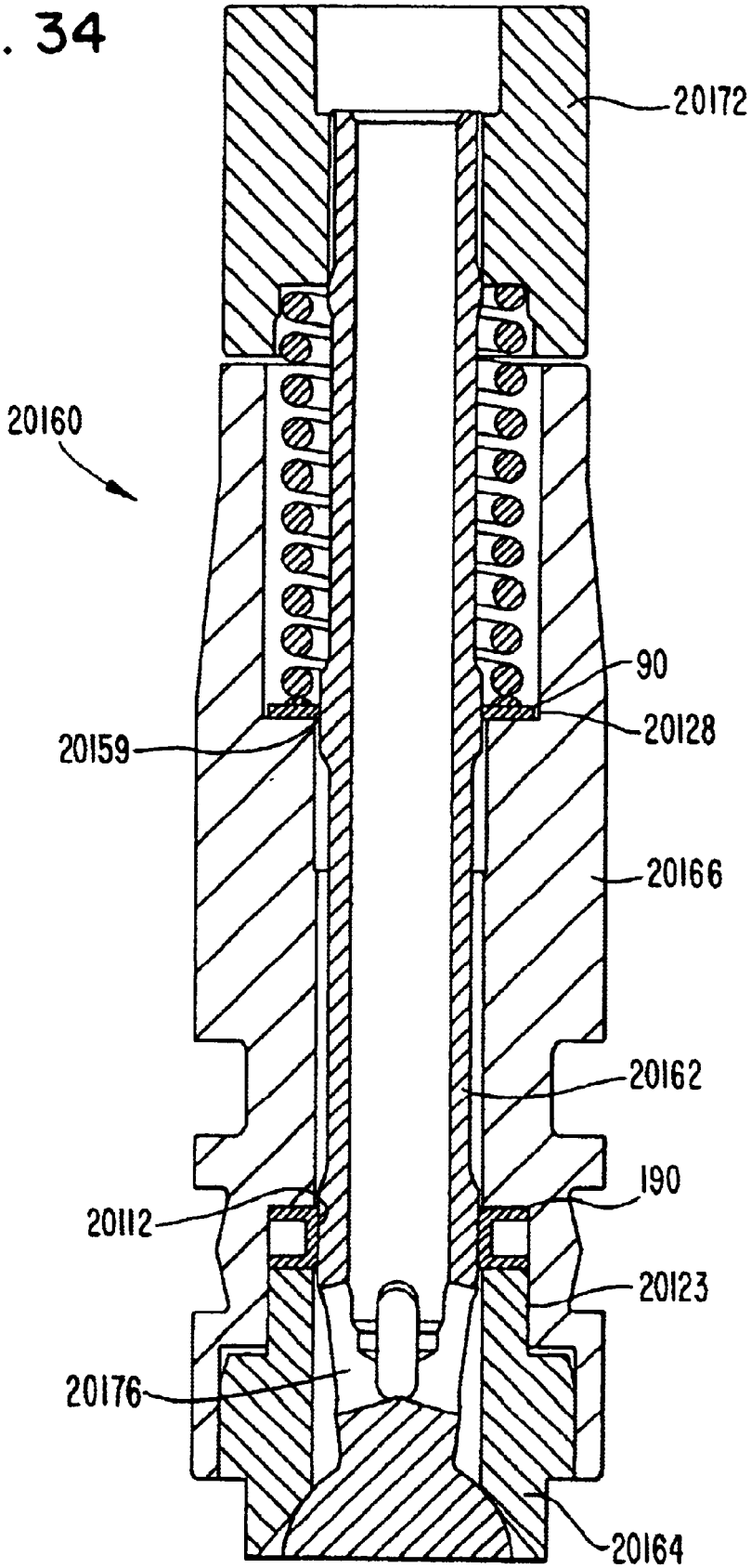
FIG. 34 is a cross-sectional view of a thirteenth alternative embodiment of a valve assembly of an air assist fuel injector according to the present invention.
Figure 35:
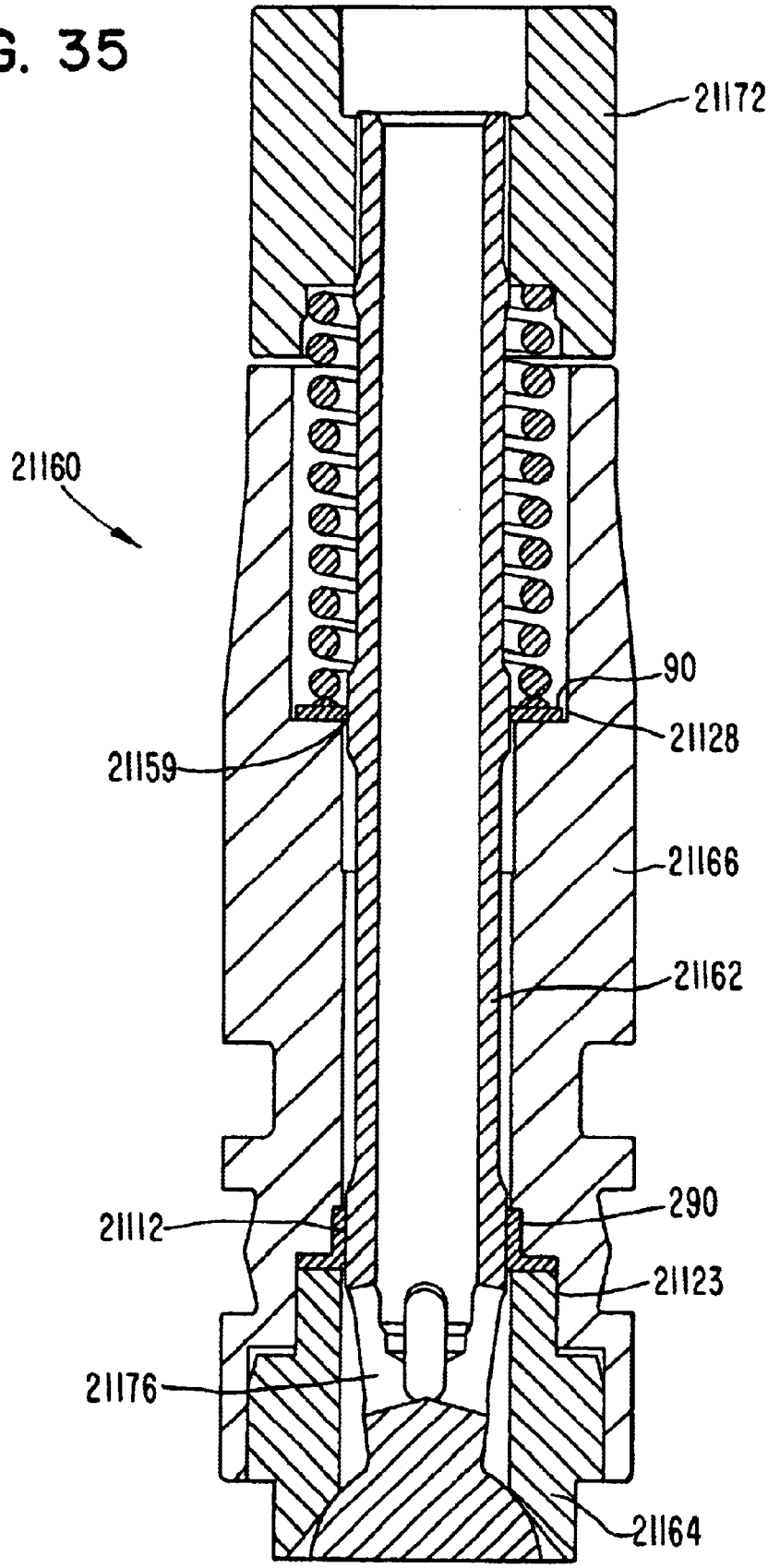
FIG. 35 is a cross-sectional view of a fourteenth alternative embodiment of a valve assembly of an air assist fuel injector according to the present invention.
Figure 36:
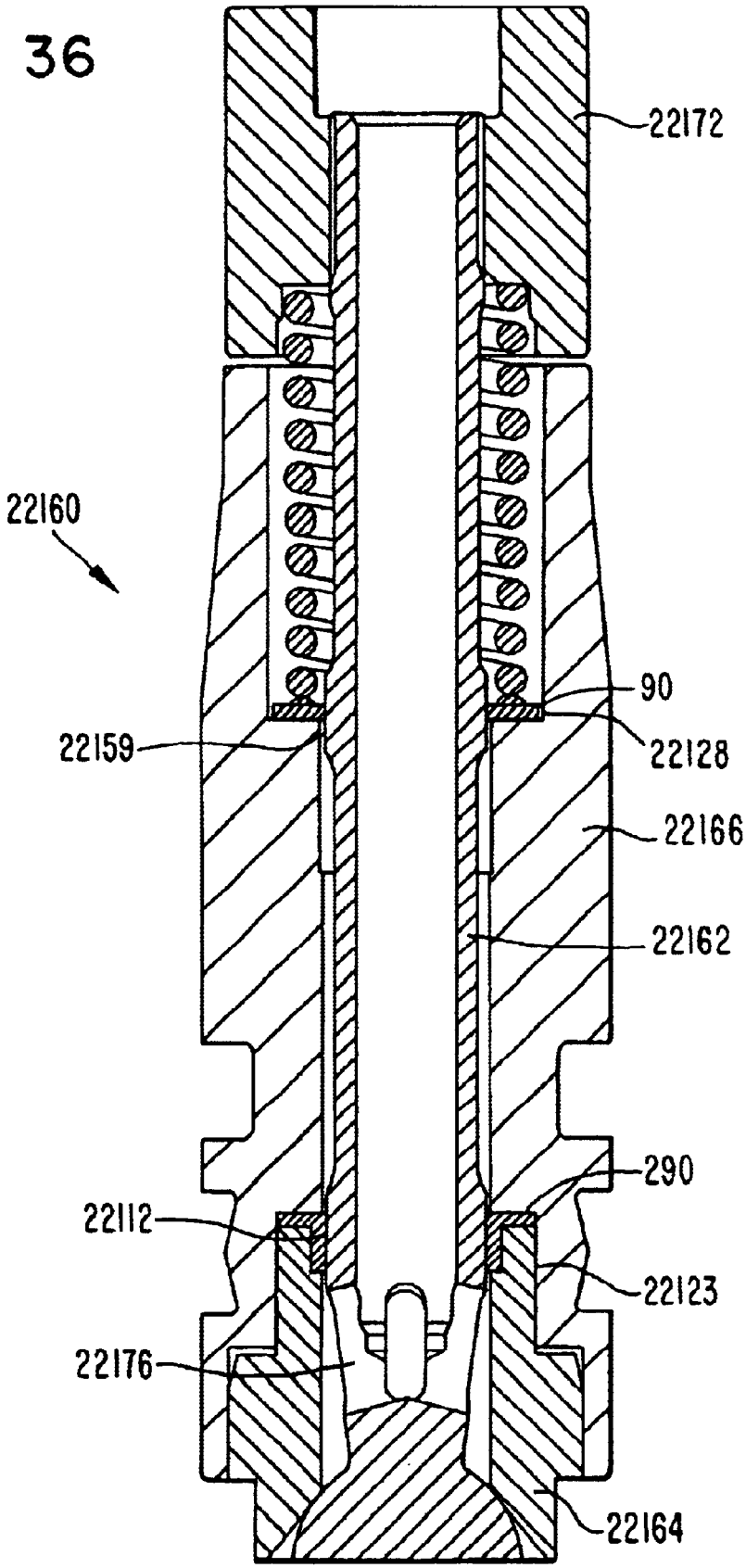
FIG. 36 is a cross-sectional view of a fifteenth alternative embodiment of a valve assembly of an air assist fuel injector according to the present invention.
Figure 37:
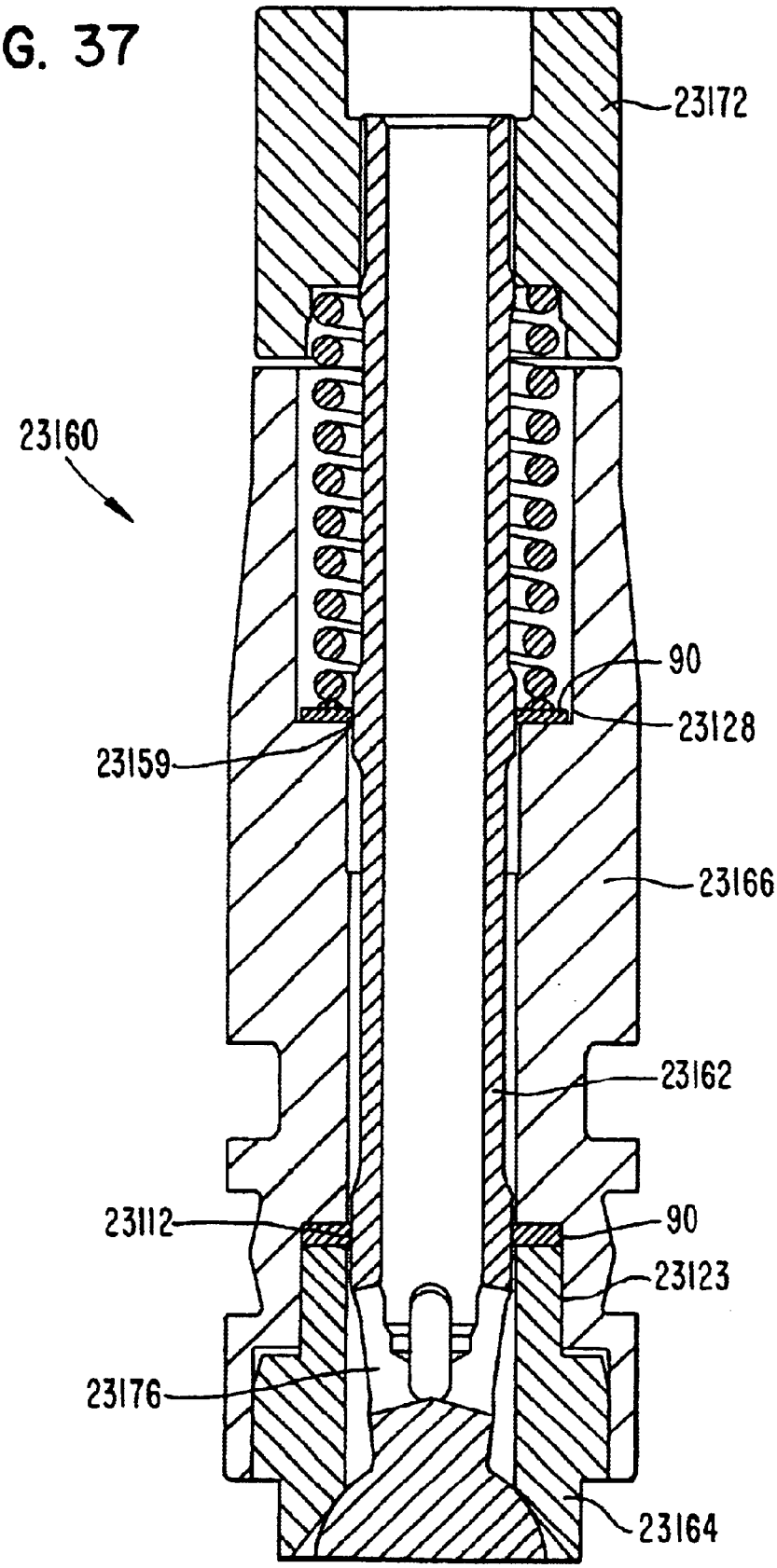
FIG. 37 is a cross-sectional view of a sixteenth alternative embodiment of a valve assembly of an air assist fuel injector according to the present invention.

As illustrated in FIGS. 22–37, the valve assemblies 8160, 9160, 10160, 11160, 12160, 13160, 14160, 15160, 16160, 17160, 18160, 19160, 20160, 21160, 22160, 23160 each include two inserts 190, 290 that each guide movement of the poppet 8162. As illustrated in FIGS. 22–37, the two inserts may be any combination of the inserts 90, 190, 290 illustrated in FIGS. 40–42 as well as other inserts. Because the valve assemblies 8160, 9160, 10160, 11160, 12160, 13160, 14160, 15160, 16160, 17160, 18160, 19160, 20160, 21160, 22160, 23160 each include two inserts, each of the poppets 8162, 9162, 10162, 11162, 12162, 13162, 14162, 15162, 16162, 17162, 18162, 19162, 20162, 21162, 22162, 23162 includes two bearing surfaces 8112, 8159, 9112, 9159, 10112, 11112, 11159, 12112, 12159, 13112, 13159, 14112, 14159, 15112, 15159, 16112, 16159, 17112, 17159, 18112, 18159, 19112, 19159, 20112, 20159, 21112, 21159, 22112, 22159, 23112, 23159. As illustrated in FIG. 22, the respective first bearing surface 8112, 9112, 10112, 11112, 12112, 13112, 14112, 15112, 16112, 17112, 18112, 19112, 20112, 21112, 22112, 23112 of the respective poppets 8162, 9162, 10162, 11162, 12162, 13162, 14162, 15162, 16162, 17162, 18162, 19162, 20162, 21162, 22162, 23162 are located downstream of the respective second bearing surface 8159, 9159, 10159, 11159, 12159, 13159, 14159, 15159, 16159, 17159, 18159, 19159, 20159, 21159, 22159, 23159 with respect to the direction of flow f. Additionally, the respective first bearing surface 8112, 9112, 10112, 11112, 12112, 13112, 14112, 15112, 16112, 17112, 18112, 19112, 20112, 21112, 22112, 23112 are each located upstream of the respective outlet 8176, 9176, 10176, 11176, 12176, 13176, 14176, 15176, 16176, 17176, 18176, 19176, 20176, 21176, 22176, 23176. Accordingly, each valve assembly 8160, 9160, 10160, 11160, 12160, 13160, 14160, 15160, 16160, 17160, 18160, 19160, 20160, 21160, 22160, 23160 includes two inserts for guiding movement of the respective poppet 8162, 9162, 10162, 11162, 12162, 13162, 14162, 15162, 16162, 17162, 18162, 19162, 20162, 21162, 22162, 23162 at two separate locations at the stem of the poppet. Because the bearing surfaces of the inserts guide movement of the respective poppet 8162, 9162, 10162, 11162, 12162, 13162, 14162, 15162, 16162, 17162, 18162, 19162, 20162, 21162, 22162, 23162, the respective seat 8164, 9164, 10164, 11164, 12164, 13164, 14164, 15164, 16164, 17164, 18164, 19164, 20164, 21164, 22164, 23164 and/or the respective leg 8166, 9166, 10166, 11166, 12166, 13166, 14166, 15166, 16166, 17166, 18166, 19166, 20166, 21166, 22166, 23166 need not be ground to produce a bearing surface therein, thus decreasing the complexity of each valve assembly.

Figure 43:
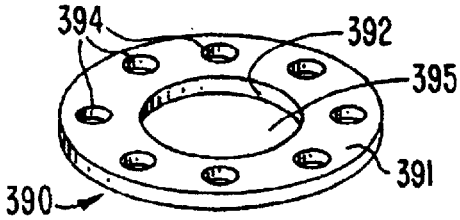
FIG. 43 is a perspective view of a fourth embodiment of an insert for use with an air assist fuel injector according to the present invention.
Figure 47:
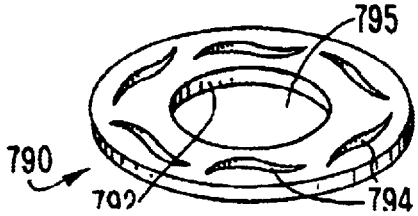
FIG. 47 is a perspective view of an eighth embodiment of an insert for use with an air assist fuel injector according to the present invention.
Figure 48:
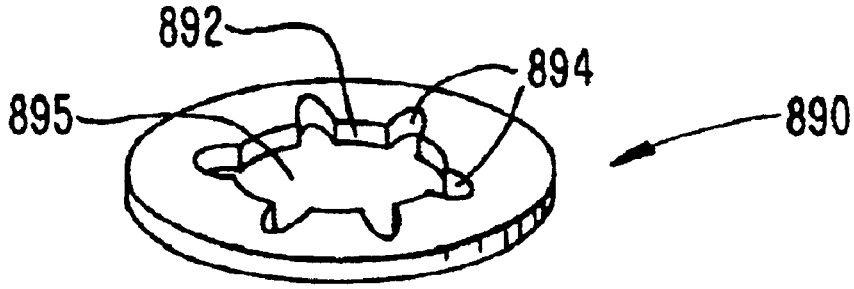
FIG. 48 is a perspective view of a ninth embodiment of an insert for use with an air assist fuel injector according to the present invention.
Figure 49:
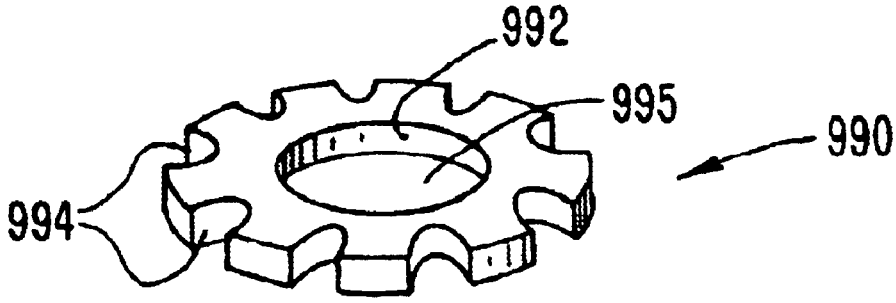
FIG. 49 is a perspective view of a tenth embodiment of an insert for use with an air assist fuel injector according to the present invention.

FIGS. 38 and 39 illustrate another embodiment of an air assist fuel injector 24100 in accordance with the present invention. As illustrated in FIG. 39, the poppet 24162 is a solid poppet. That is, the poppet does not have an internal passageway for conveying a mixture of liquid fuel and gas as in the previously illustrated embodiments. Rather, the mixture of liquid fuel and gas is conveyed through the channel 24165 of leg 24166 outside of the poppet 24162. The armature 24172 includes a passageway 24180 that conveys the liquid fuel and gas to one or more additional passageways 24440 that convey the liquid fuel and gas to the channel 24165 of the leg 24166. The armature 24172 includes a cylindrical passageway 24126 that matingly receives the solid poppet 24162, where the poppet is attached to the armature. As illustrated in FIG. 39, the additional passageways 24440 pass through the armature 24172 so as to communicate the passageway 24180 with the bore 24171 of the channel 24165. The liquid fuel and gas enter the passageway 24180 of the armature 24172, where the mixture is conveyed to the additional passageways 24390, which in turn communicate the mixture to the channel 24165 of the leg 24166. The mixture flows along the stem of the poppet 24162 in the channel 24165. In the embodiment illustrated in FIG. 39, the sleeve 24168 slidably engages the armature 24172 to guide movement of the armature. The air assist fuel injector 24100 also includes an insert 390 (illustrated in FIG. 43) that guides movement of the poppet 24162. The insert 390 is identical to the insert 90, except for the inclusion of passageways 394. Hence, the insert 390 includes a throughole 395 and a bearing surface 392 that slidably engages a bearing surface 24112 of the poppet 24162 to guide movement of the poppet. The passageways 394 are throughholes that pass through the wall 391 of the insert 390 and that communicate liquid fuel and gas from an area located upstream of the insert 390 with an area located downstream of the insert with respect to the direction of flow f. Hence, the passageways convey liquid fuel and gas travelling through the channel 24165 such that when the armature 24172 and poppet 24162 are actuated, the liquid fuel and gas is conveyed downstream of the insert 390 and out of the air assist fuel injector 24100.

In the illustrated embodiment the passageways 394 include eight cylindrical throughholes equidistantly spaced from each other about the center throughole 395 that slidably engages the poppet 24162. In alternative embodiments, the passageways 394 may take other configurations. For example, FIGS. 44–49 illustrate embodiments of inserts 490, 590, 690, 790, 890, 990 each having one or more passageways 494, 594, 694, 794, 894, 994 for conveying liquid fuel and gas in the channel 24165 of the air assist fuel injector 24100 and each having a bearing surface 492, 592, 692, 792, 892, 992 for slidably engaging the bearing surface of a poppet to guide movement of the poppet.

The insert 490 includes a passageway 494 in the form of a slot passing through the wall 491. The insert 590 is spool-shaped, similar to the insert 190, and includes four cylindrical passageways 594 passing through each annular wall 597, 598. The insert 690 includes four oval passageways 694, and the insert 790 includes six curved passageways 794. The insert 890 includes six passageways 894 defined by recesses or grooves in the circumference of the bearing surface 892. Each passageway 894 extends radially away from the bearing surface in a direction toward the outer cylindrical surface of the insert. The insert 990 includes nine passageways 994 defined by recesses or grooves in the circumference of outer cylindrical surface of the insert. Each passageway 994 extends radially away from the outer cylindrical surface in a direction toward the bearing surface 992. As will be appreciated, alternative embodiments of the inserts may include differently configured passageways and still be within the confines of the present invention.

We claim:

1. An air assist fuel injector, comprising:

a poppet having a stem and a head;

a seat member defining a seat for said head of said poppet;

a leg having a channel that receives at least a portion of said poppet, said channel having a bore that receives said seat member, said bore having a diameter that is greater than a diameter of another portion of said channel; and at least one insert having a surface that slidably engages at least a portion of said stem of said poppet to guide movement of said poppet, said insert being separate from said seat member and said leg, said air assist fuel injector being configured such that gas and liquid fuel delivered to said injector mix inside said injector at a location upstream of said seat with respect to a direction of flow of liquid fuel and gas through said injector.

2. The air assist fuel injector of claim 1, further comprising:

an armature; and a solenoid for actuating said armature, said poppet being attached to said armature.

3. The assist fuel injector of claim 1, said insert being located at least partially within said channel.

4. The air assist fuel injector of claim 1, said insert being located between opposing faces of said leg and said seat member.

5. The air assist fuel injector of claim 1, said bore being a first bore in a first end of said leg, said leg including a second bore in a second end of said leg located opposite from said first end, said second bore receiving at least a portion of said insert and having a diameter that is greater than said diameter of said another portion of said channel.

6. The air assist fuel injector of claim 1, said at least one insert being a first insert, further comprising a second insert having a surface that slidably engages at least another portion of said stem to guide movement of said poppet, said second insert being separate from said seat member and said leg.

7. The air assist fuel injector of claim 6, said first insert being located between opposing faces of said leg and said seat member.

8. The air assist fuel injector of claim 6, said second insert being located upstream of said first insert with respect to the direction of flow of liquid fuel and gas through said air assist fuel injector.

9. The air assist fuel injector of claim 1, said stem of said poppet having a first bearing surface and a second bearing surface, said second bearing surface being located upstream of said first bearing surface with respect to the direction of flow of liquid fuel and gas through said air assist fuel injector.

10. The air assist fuel injector of claim 9, said portion of said stem slidably engaged by said surface of said insert being said first bearing surface of said poppet.

11. The air assist fuel injector of claim 9, said portion of said stem slidably engaged by said surface of said insert being said second bearing surface of said poppet.

12. The air assist fuel injector of claim 9, said insert being a first insert, further comprising a second insert, said portion of said stem slidably engaged by said first insert being said first bearing surface of said poppet, said second insert having a surface that slidably engages said second bearing surface of said poppet.

13. The air assist fuel injector of claim 1, said insert being a planar disk, said surface of said insert being an interior surface of a throughole passing through said planar disk.

14. The air assist fuel injector of claim 1, said insert being a spool-shaped member.

15. The air assist fuel injector of claim 1, said surface of said insert being a turned surface.

16. The air assist fuel injector of claim 1, said insert having a planar portion and a lip transversely protruding from said planar portion.

17. The air assist fuel injector of claim 1, said insert further comprising a passageway passing through a wall of said insert for conveying liquid fuel and gas.

18. The air assist fuel injector of claim 17, said passageway being one of a plurality of passageways that pass through said wall.

19. The air assist fuel injector of claim 1, said poppet not having an internal and elongated passageway for conveying liquid fuel and gas through said poppet, said insert having at least one wall and at least one passageway passing through said wall for conveying liquid fuel and gas.

20. The air assist fuel injector of claim 1, further comprising an armature attached to said poppet and a spring biasing said armature away from said leg, said insert being located between said spring and said leg.

21. The air assist fuel injector of claim 1, said insert being located at least partially upstream of said seat member with respect to the direction of flow of liquid fuel and gas through said air assist fuel injector.

22. An air assist fuel injector, comprising:

a poppet having a head and a stem;

a seat member defining a seat for said head of said poppet;

a leg having a channel that receives at least a portion of said poppet, said channel having a bore that receives said seat member, said bore having a diameter that is greater than a diameter of another portion of said channel; and means for guiding movement of said poppet at a bearing surface of said poppet, said means for guiding being separate from said leg and said seat, said air assist fuel injector being configured such that gas and liquid fuel delivered to said injector mix inside said injector at a location upstream of said seat with respect to a direction of flow of liquid fuel and gas through said injector.

23. The air assist fuel injector of claim 22, said bearing surface being a sole bearing surface of said poppet.

24. The air assist fuel injector of claim 22, said bearing surface being a first bearing surface, said poppet further comprising a second bearing surface, said second bearing surface being located upstream of said first bearing surface with respect to the direction of flow of liquid fuel and gas through said air assist fuel injector.

25. The air assist fuel injector of claim 22, further comprising:

an armature; and a solenoid for actuating said armature, said poppet being attached to said armature.

26. The air assist fuel injector of claim 25, further comprising an armature guide for guiding movement of said armature.

27. An air assist fuel injector comprising:

a poppet having a stem and a head;

a seat member defining a seat for said head of said poppet; and a leg having a channel that receives at least a portion of said poppet, said leg having a recess that receives said seat member and an insert, said insert being separate from said seat member and said leg and having a planar and annular wall with a cylindrical throughole passing therethrough said cylindrical throughole including a cylindrical surface that slidably engages said stem, said seat member not having a bearing surface that slidably engages said stem to guide movement of said poppet, said air assist fuel injector being configured such that gas and liquid fuel delivered to said injector mix inside said injector at a location upstream of said seat with respect to a direction of flow of liquid fuel and gas through said injector.

28. The air assist fuel injector of claim 27, said leg not having a bearing surface that slidably engages said stem to guide movement of said poppet.

29. An air assist fuel injector, comprising:

a poppet having a stem and a head;

a seat member defining a seat for said head of said poppet;

a leg having a channel that receives at least a portion of said poppet, said channel having a bore that receives said seat member, said bore having a diameter that is greater than a diameter of another portion of said channel; and at least one insert having a surface that slidably engages at least a portion of said stem of said poppet to guide movement of said poppet, said insert being separate from said seat member and said leg, said insert having a planar portion and a lip transversely protruding from said planar portion.

30. The air assist fuel injector of claim 29, further comprising:

an armature; and a solenoid for actuating said armature, said poppet being attached to said armature.

31. The air assist fuel injector of claim 29, said insert being located at least partially within said channel.

32. The air assist fuel injector of claim 29, said insert being located between opposing faces of said leg and said seat member.

33. The air assist fuel injector of claim 29, said bore being a first bore in a first end of said leg, said leg including a second bore in a second end of said leg located opposite from said first end, said second bore receiving at least a portion of said insert and having a diameter that is greater than said diameter of said another portion of said channel.

34. The air assist fuel injector of claim 29, said at least one insert being a first insert, further comprising a second insert having a surface that slidably engages at least another portion of said stem to guide movement of said poppet, said second insert being separate from said seat member and said leg.

35. The air assist fuel injector of claim 34, said first insert being located between opposing faces of said leg and said seat member.

36. The air assist fuel injector of claim 34, said second insert being located upstream of said first insert with respect to a direction of flow of liquid fuel and gas through said air assist fuel injector.

37. The air assist fuel injector of claim 29, said stem of said poppet having a first bearing surface and a second bearing surface, said second bearing surface being located upstream of said first bearing surface with respect to a direction of flow of liquid fuel and gas through said air assist fuel injector.

38. The air assist fuel injector of claim 37, said portion of said stem slidably engaged by said surface of said insert being said first bearing surface of said poppet.

39. The air assist fuel injector of claim 37, said portion of said stem slidably engaged by said surface of said insert being said second bearing surface of said poppet.

40. The air assist fuel injector of claim 37, said insert being a first insert, further comprising a second insert, said portion of said stem slidably engaged by said first insert being said first bearing surface of said poppet, said second insert having a surface that slidably engages said second bearing surface of said poppet.

41. The air assist fuel injector of claim 29, said insert being a spool-shaped member.

42. The air assist fuel injector of claim 29, said surface of said insert being a turned surface.

43. The air assist fuel injector of claim 29, said insert further comprising a passageway passing through a wall of said insert for conveying liquid fuel and gas.

44. The air assist fuel injector of claim 43, said passageway being one of a plurality of passageways that pass through said wall.

45. The air assist fuel injector of claim 29, further comprising an armature attached to said poppet and a spring biasing said armature away from said leg, said insert being located between said spring and said leg.

46. The air assist fuel injector of claim 29, said insert being located at least partially upstream of said seat member with respect to a direction of flow of liquid fuel and gas through said air assist fuel injector.

47. An air assist fuel injector, comprising:

a poppet having a stem and a head, said poppet having an internal and elongated passageway for conveying liquid fuel and gas through said poppet;

at least one inlet for receiving at least a gas, said inlet being located upstream of said poppet with respect to a direction of flow of said liquid fuel and gas through said injector;

a seat member defining a scat for said head of said poppet;

a leg having a channel for receiving at least a portion of said poppet; and at least one insert having a surface that slidably engages at least a portion of said stem of said poppet to guide movement of said poppet, said insert being separate from said seat and said leg.

48. The air assist fuel injector of claim 47, further comprising:

an armature; and a solenoid for actuating said armature, said poppet being attached to said armature.

49. The air assist fuel injector of claim 47, said insert being located at least partially within said channel.

50. The air assist fuel injector of claim 47, said insert being located between opposing faces of said leg and said seat member.

51. The air assist fuel injector of claim 47, said channel having a bore that receives said seat member, said bore having a diameter that is greater than a diameter of another portion of said channel.

52. The air assist fuel injector of claim 47, said at least one insert being a first insert, further comprising a second insert having a surface that slidably engages at least another portion of said stem to guide movement of said poppet, said second insert being separate from said seat member and said leg.

53. The air assist fuel injector of claim 52, said first insert being located between opposing faces of said leg and said seat member.

54. The air assist fuel injector of claim 47, said stem of said poppet having a first bearing surface and a second bearing surface, said second bearing surface being located upstream of said first bearing surface with respect to the direction of flow of liquid fuel and gas through said air assist fuel injector.

55. The air assist fuel injector of claim 54, said portion of said stem slidably engaged by said surface of said insert being said first bearing surface of said poppet.

56. The air assist fuel injector of claim 54, said portion of said stem slidably engaged by said surface of said insert being said second bearing surface of said poppet.

57. The air assist fuel injector of claim 54, said insert being a first insert, further comprising a second insert, said portion of said stem slidably engaged by said first insert being said first bearing surface of said poppet, said second insert having a surface that slidably engages said second bearing surface of said poppet.

58. The air assist fuel injector of claim 47, said insert being a planar disk, said surface of said insert being an interior surface of a throughole passing through said planar disk.

59. The air assist fuel injector of claim 47, said insert being a spool-shaped member.

60. The air assist fuel injector of claim 47, said surface of said insert being a turned surface.

61. The air assist fuel injector of claim 47, said insert having a planar portion and a lip transversely protruding from said planar portion.

62. The air assist fuel injector of claim 47, said insert further comprising at least one passageway passing through a wall of said insert for conveying liquid fuel and gas.

63. An air assist fuel injector, comprising:

a poppet configured to open in a direction of flow of liquid fuel and gas through said injector to discharge liquid fuel and gas from said injector, said poppet having a stem and a head;

a seat member defining a seat for said head of said poppet;

a leg having a channel that receives at least a portion of said poppet, said channel having a bore that receives said seat member, said bore having a diameter that is greater than a diameter of another portion of said channel; and at least one insert having a surface that slidably engages at least a portion of said stem of said poppet to guide movement of said poppet, said insert being separate from said seat member and said leg.

64. The air assist fuel injector of claim 63, said insert being located between opposing faces of said leg and said seat member.

65. The air assist fuel injector of claim 63, said bore being a first bore in a first end of said leg, said leg including a second bore in a second end of said leg located opposite from said first end, said second bore receiving at least a portion of said insert and having a diameter that is greater than said diameter of said another portion of said channel.

66. The air assist fuel injector of claim 63, said at least one insert being a first insert, further comprising a second insert having a surface that slidably engages at least another portion of said stem to guide movement of said poppet, said second insert being separate from said seat member and said leg.

67. The air assist fuel injector of claim 66, said first insert being located between opposing faces of said leg and said seat member.

68. The air assist fuel injector of claim 66, said second insert being located upstream of said first insert with respect to the direction of flow of liquid fuel and gas through said air assist fuel injector.

69. The air assist fuel injector of claim 63, said insert being a planar disk, said surface of said insert being an interior surface of a throughole passing through said planar disk.

70. The air assist fuel injector of claim 63, said insert being a spool-shaped member.

71. The air assist fuel injector of claim 63, said surface of said insert being a turned surface.

72. The air assist fuel injector of claim 63, said insert having a planar portion and a lip transversely protruding from said planar portion.

73. The air assist fuel injector of claim 63, said insert further comprising at least one passageway passing through a wall of said insert for conveying liquid fuel and gas.

74. The air assist fuel injector of claim 63, further comprising an armature attached to said poppet and a spring biasing said armature away from said leg, said insert being located between said spring and said leg.

75. The air assist fuel injector of claim 63, said insert being located at least partially upstream of said seat member with respect to the direction of flow of liquid fuel and gas through said air assist fuel injector.

76. An air assist fuel injector, comprising:

a poppet having a stem and a head;

a seat member defining a seat for said head of said poppet;

a leg having a channel that receives at least a portion of said poppet;

at least one insert having a surface that slidably engages at least a portion of said stem of said poppet to guide movement of said poppet, said insert being separate from said seat member and said leg, said air assist fuel injector being configured such that gas and liquid fuel delivered to said injector mix inside said injector at a location upstream of said seat with respect to a direction of flow of liquid fuel and gas through said injector; and an armature attached to said poppet and a spring biasing said armature away from said leg, said insert being located between said spring and said leg.

* * * * *

UNITED STATES PATENT AND TRADEMARK OFFICE

CERTIFICATE OF CORRECTION

PATENT NO. : 7,104,477 B2
APPLICATION NO. : 09/950586
DATED : September 12, 2006
INVENTOR(S) : David Kilgore et al.

It is certified that error appears in the above-identified patent and that said Letters Patent is hereby corrected as shown below:

Column 13
Line 28, replace “The assist fuel” with --The air assist fuel --.

Column 16
Line 38, replace “scat” with -- seat --.

Signed and Sealed this

Twenty-eighth Day of November, 2006

JON W. DUDAS
*Director of the United States Patent and Trademark Office*